US010549159B2

(12) United States Patent
Simonutti et al.

(10) Patent No.: US 10,549,159 B2
(45) Date of Patent: Feb. 4, 2020

(54) TENNIS BALL HAVING A CORE WITH AERODYNAMIC PATTERNS

(71) Applicant: Wilson Sporting Goods Co., Chicago, IL (US)

(72) Inventors: Frank M. Simonutti, Wheaton, IL (US); William E. Dillon, Chicago, IL (US); David A. Vogel, Island Lake, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/458,844

(22) Filed: Mar. 14, 2017

(65) Prior Publication Data

US 2018/0264326 A1 Sep. 20, 2018

(51) Int. Cl.

| | |
|---|---|
| ***A63B 39/06*** | (2006.01) |
| ***A63B 102/02*** | (2015.01) |
| *A63B 39/00* | (2006.01) |

(52) U.S. Cl.

CPC ..... *A63B 39/06* (2013.01); *A63B 2039/003* (2013.01); *A63B 2102/02* (2015.10)

(58) Field of Classification Search

CPC ... A63B 39/08; A63B 43/002; A63B 2102/02; A63B 2039/006; A63B 2039/003; A63B 37/06; A63B 39/06; A63B 39/00

See application file for complete search history.

(56) References Cited

U.S. PATENT DOCUMENTS

| | | | | | |
|---|---|---|---|---|---|
| 398,558 | A | * | 2/1889 | Waddington | B21D 51/08 29/899.1 |
| 711,508 | A | * | 10/1902 | Kempshall | A63B 37/0097 473/355 |
| 902,330 | A | * | 10/1908 | Rowley | B29C 65/62 156/147 |
| 1,287,766 | A | * | 12/1918 | Saunders | A63B 41/08 473/604 |
| 1,376,778 | A | | 5/1921 | Orr | |
| 1,482,232 | A | * | 1/1924 | Hazeltine | A63B 37/0003 473/355 |
| 2,129,238 | A | * | 9/1938 | Riddell | 156/147 |
| 2,210,954 | A | * | 8/1940 | Roberts | B29D 22/04 156/161 |
| 2,307,182 | A | * | 1/1943 | Young | A63B 37/0003 473/354 |
| 3,065,520 | A | | 11/1962 | Schmidt | |

(Continued)

FOREIGN PATENT DOCUMENTS

| | | | |
|---|---|---|---|
| GB | 719467 | A | 12/1954 |
| GB | 2200849 | A | 8/1988 |

OTHER PUBLICATIONS

"Tennis Ball Trajectories", «http://twu.tennis-warehouse.com/learning_center/aerodynamics2.php», Dec. 22, 2013, retrieved on Oct. 17, 2018, pp. 1-5.*

(Continued)

*Primary Examiner* — Steven B Wong
(74) *Attorney, Agent, or Firm* — Terence P. O'Brien; Todd A. Rathe

(57) ABSTRACT

A tennis ball comprises a hollow elastic circumferential core defining a primary outer surface pattern, and a textile outer layer extending over and about the core.

21 Claims, 17 Drawing Sheets

(56) References Cited

U.S. PATENT DOCUMENTS 3,256,019 A * 6/1966 Barton ..... A63B 37/0097 156/170
3,396,970 A 8/1968 Fraser et al.
3,442,101 A 5/1969 Ploch et al.
3,534,965 A * 10/1970 Broughton ..... B29D 99/0042 273/DIG. 10
3,684,284 A 8/1972 Tranfield
3,904,201 A 9/1975 Henry
4,022,469 A 5/1977 Lacoste et al.
RE29,303 E 7/1977 Fraser et al.
4,098,504 A 7/1978 Koziol et al.
4,229,401 A * 10/1980 Pocklington ..... A63B 37/0097 156/228
4,249,730 A 2/1981 Frisk
4,300,767 A 11/1981 Reed et al.
4,305,583 A * 12/1981 Tandon ..... A63B 39/00 473/609
4,318,875 A 3/1982 Shrimton et al.
4,340,222 A 7/1982 Kerkenbush et al.
4,439,471 A * 3/1984 Lacoste ..... A63B 39/06 428/36.1
4,610,071 A * 9/1986 Miller ..... A63B 37/00 156/73.5
4,616,828 A 10/1986 Haythornthwaite
4,739,989 A * 4/1988 Prinz ..... A63B 39/00 273/DIG. 20
4,853,056 A 8/1989 Hoffman
4,853,057 A 8/1989 Hoffman
4,946,166 A 8/1990 Horiuchi et al.
4,947,466 A 8/1990 Horiuchi et al.
5,209,471 A 5/1993 Horiuchi et al.
5,211,788 A 5/1993 Song
5,225,258 A 7/1993 Nakamura et al.
5,308,060 A 5/1994 Nakamura et al.
5,413,333 A 5/1995 James et al.
5,460,367 A 10/1995 Horiuchi
5,551,688 A 9/1996 Miller
5,558,325 A 9/1996 Hargis et al.
5,593,157 A 1/1997 Koros et al.
5,830,092 A 11/1998 Meeks
6,030,304 A 2/2000 Simonutti et al.
6,106,419 A 8/2000 Hall et al.
6,186,095 B1 * 2/2001 Simon ..... A01K 15/025 119/707
6,227,992 B1 5/2001 Brasier
6,267,695 B1 * 7/2001 Masutani ..... A63B 37/0003 473/367
6,293,877 B1 * 9/2001 Boehm ..... A63B 37/0003 473/361
6,379,270 B2 * 4/2002 Maruko ..... A63B 37/0003 473/367
6,508,732 B1 1/2003 Romberger et al.
6,595,875 B1 * 7/2003 Oh ..... A63B 37/0003 473/373
6,677,257 B2 1/2004 Brasier
6,773,364 B2 * 8/2004 Sullivan ..... A63B 37/0003 473/370
7,022,034 B2 * 4/2006 Sullivan ..... A63B 37/0003 473/374
7,125,347 B2 * 10/2006 Kawamatsu ..... A63B 37/0004 473/378
7,611,429 B2 11/2009 O'Neill et al.
7,985,779 B2 7/2011 Vleghert
D668,947 S 10/2012 Niksich
10,226,670 B2 * 3/2019 Sullivan ..... A63B 37/0062
2001/0027140 A1 * 10/2001 Bellinger ..... A63B 37/0003 473/356
2005/0026521 A1 2/2005 Brasier
2008/0248898 A1 * 10/2008 Morgan ..... A63B 37/0003 473/373
2009/0007854 A1 * 1/2009 Cooper ..... A01K 15/025 119/707
2009/0318251 A1 12/2009 Limerkens et al.
2010/0069176 A1 * 3/2010 Aoyama ..... A63B 37/0004 473/383
2010/0261563 A1 10/2010 Verbeke et al.
2010/0307637 A1 12/2010 Dirst
2012/0165143 A1 6/2012 Kanda et al.
2012/0298050 A1 11/2012 Merritt
2012/0302377 A1 * 11/2012 Sato ..... A63B 37/0004 473/383
2013/0017912 A1 1/2013 DeAngelis-Duffy
2013/0324325 A1 * 12/2013 Maxwell ..... A63B 37/0019 473/377
2015/0011331 A1 * 1/2015 Ishii ..... A63B 37/0076 473/373
2015/0011332 A1 * 1/2015 Ishii ..... A63B 37/0062 473/373
2015/0018127 A1 * 1/2015 Ishii ..... A63B 37/0075 473/376

OTHER PUBLICATIONS

<https://www.vocabulary.com/dictionary/dimple., retrieved on Mar. 19, 2019.*

* cited by examiner

TENNIS BALL HAVING A CORE WITH AERODYNAMIC PATTERNS

BACKGROUND

Tennis balls typically include an elastomeric a rubber-like core about which two panels of felt or other textile is bonded. In one implementation, the two panels can be "stadium" or ovular shaped, and in another implementation, the two panels can be "dog-bone" shaped. Many tennis balls are pressurized to enhance rebound or bounce performance. Over time, pressurized tennis balls degrade in performance.

DETAILED DESCRIPTION OF EXAMPLES

Figure 1C:
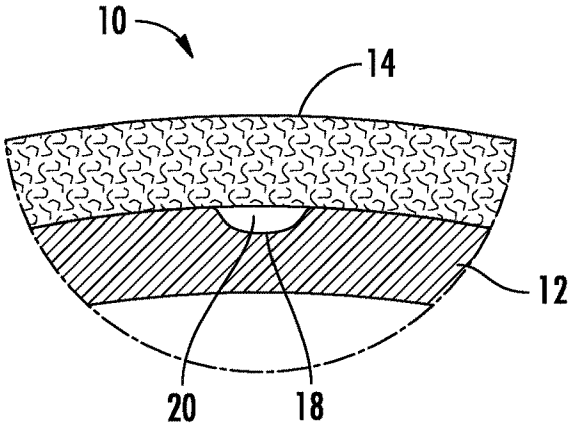
FIG. 1C is a section view of section 1C of the tennis ball of FIG. 1A.

Disclosed herein are examples of tennis balls that experienced lower degrees of drag, or exhibit a lower drag coefficient, during play. A decrease in the coefficient of drag of the tennis ball results in improved aerodynamic performance resulting in more efficient flight—longer length and/or a higher net height of the ball travel when the ball is hit at a comparable velocity compared to a conventional tennis ball. Such longer travel distance and/or height improves the performance of the ball and may prolong the life of the tennis ball. The aerodynamic performance of the tennis ball is improved by incorporating turbulence generating patterns on the core of the tennis ball. The addition of patterns on the core of the tennis ball results in increased turbulent flow during flight of the tennis ball. The increased turbulent flow reduces the drag coefficient of the tennis ball resulting in more efficient flight including the tennis ball flying further at the same ball velocity than a tennis ball formed without turbulence generating patterns on its core. In some circumstances, such improved aerodynamic performance and/or travel distance may be preferred by certain tennis players. In some circumstances, such improved aerodynamic performance, with other modifications, facilitate pressure-less tennis balls. As will be described hereafter, the lower drag and greater travel distance of the example tennis balls can be achieved without changing the material construction of the tennis ball, without substantially altering the outer aesthetic appearance of the tennis ball, without substantially altering coefficient of restitution (COR) of the tennis ball, and/or while maintaining bounce consistency and uniformity of the tennis ball.

In the examples described herein, the tennis balls comprise a hollow elastic or elastomeric circumferential core and a textile outer layer over and about the core. The outer surface of the core can include a plurality of recesses, depressions, dimples and/or channels, and the textile outer layer can extends over the recesses, depressions and/or channels. The outer textile layer has a generally uniform exterior surface, substantially maintaining the outer aesthetic appearance of the tennis ball. The outer textile layer facilitates airflow through the textile layer and across or through the recesses, depressions and/or channels, reducing drag and increasing ball speed. For purposes of this disclosure, the term "textile" refers to a cloth or woven or felted fabric that permits airflow, to at least some degree, completely through its thickness, from an inner face to an outer face. In one implementation, the textile can be a woven felt. In another implementation, the textile can be a need punch felt. The felt can be formed of a natural fiber, such as wool, a synthetic fiber, such as synthetic wool, polyester, nylon and other polymeric fibers, or combinations thereof. One example of a textile is felt which is the result of a wool or other suitable textile that is rolled and impressed with the accompanying application of moisture and/or heat to cause a constituent fibers to mat together to create a smooth surface.

In addition to facilitating airflow through the thickness of the outer textile layer in and across the recesses, depressions and/or channels to reduce drag, the outer textile later may further serve as a filter, inhibiting or blocking dirt, debris and other particles from entering such recesses, depressions and/or channels. In some implementations, the outer textile layer may enable the width/area, depth and/or frequency of such recesses, depressions and/or channels to be increased for enhanced drag reduction without corresponding entrapment of dirt, debris and other particles within such voids. This may be especially beneficial on some court surfaces such as clay.

The example tennis balls disclosed herein are provided with the recesses, depressions, voids and/or channels and the overlying outer textile layer in various manners. In one implementation, the recesses, depressions, voids and/or channels are formed in the outer surface of the circumferential core, wherein the outer textile layer is bonded directly or indirectly to the circumferential core over the recesses, depressions, voids and/or channels. In another implementation, the recesses, depressions, and/or channels are formed in and on an underside of the outer textile layer itself, wherein the voids are sandwiched between outer radial portions of the outer textile layer and the circumferential core. In yet another implementation, an intermediate layer is sandwiched between the circumferential core and the outer textile layer, wherein the intermediate layer provides the recesses, depressions, and/or channels. In one implementation, the recesses, depressions, and/or channels only partially extend through the thickness of the intermediate layer, wherein the recesses, depressions, and/or channels are located in an along an outer surface of the intermediate layer, adjacent to and facing the outer textile layer. In another implementation, the recesses, depressions, and/or channels only partially extend through the thickness of the intermediate layer, wherein the recesses, depressions, and/or channels are located in an along an inner surface of the intermediate layer, adjacent to and facing the circumferential core. In yet another implementation, the recesses, depressions, and/or channels comprise through holes or channels completely extending through the intermediate layer. In those implementations in which the recesses, channels or depressions extend along the inner surface of the intermediate layer, adjacent to and facing the circumferential core, those portions of the intermediate layer between the recesses, grooves or depressions and the outer textile layer are formed from a textile material or are perforated to facilitate airflow into and out of the recesses, depressions, and/or channels.

In yet another implementation, the intermediate layer may undulate, providing voids in the form of outwardly facing valleys or depressions through which air flows to reduce drag. In some implementations, the undulating intermediate layer may be perforate or may be formed from a textile that facilitate airflow through the intermediate layer and through the inwardly facing valleys or depressions of the undulating intermediate layer to provide enhanced drag reduction. In some implementations, the undulating intermediate layer may be formed from an elastomeric material, enhancing bounce performance. In some implementations, the inwardly facing valleys or depressions of the undulating intermediate layer may be sealed against the circumferential core and may define pressurized volumes between intermediate layer and the circumferential core. In other implementations, the outer surface of the circumferential core can include a plurality of projections in lieu of recesses, depressions, and/or channels. In other implementations, the tennis ball may have a mixture of projections and recesses, depressions, and/or channels.

Figure 1A:
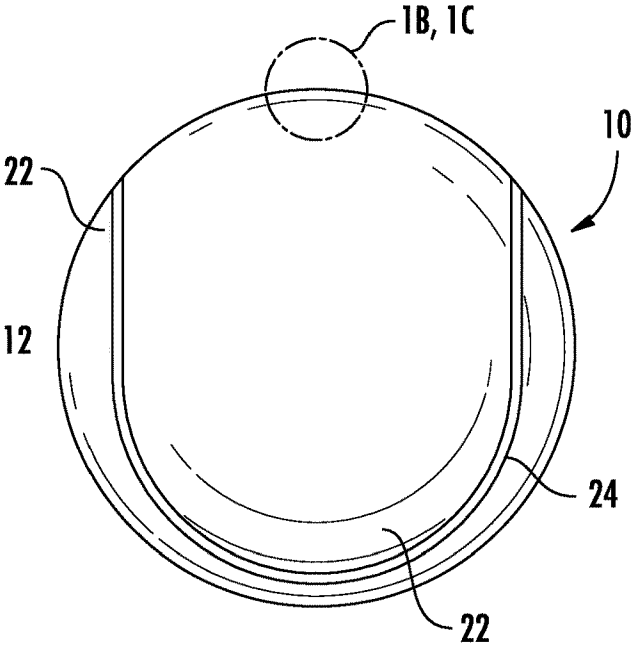
FIG. 1A is a side view of an example tennis ball.
Figure 1B:
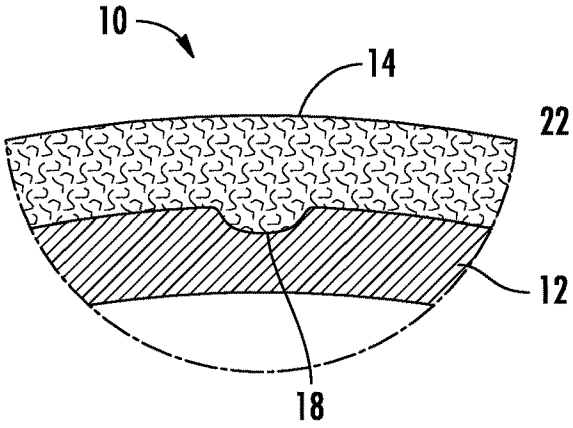
FIG. 1B is a section view of section 1B of the tennis ball of FIG. 1A.

FIGS. 1A and 1B illustrate one implementation of the present invention. Tennis ball 10 comprises a hollow elastic or elastomeric circumferential core 12 having an outer surface 16 and a textile outer layer 14 extending over the core 12. The outer surface 16 defines a plurality of recesses 18. In other implementations, the recesses 18 can be depressions, channels, grooves and combinations thereof. In one implementation, the outer textile layer 14 provides tennis ball 10 with a substantially uniform exterior surface, substantially maintaining the outer aesthetic appearance of the tennis ball 10. The inner surface of the outer textile layer 14 can confirm to the shape of the outer surface 16 and fill or substantially fill the recesses 18 (or depressions, channels, grooves and/or combinations thereof) formed in the outer surface 16 of the core 12. In the implementation of FIG. 1B, the outer layer 14 can be formed of a needle punch felt. The outer textile layer 14 facilitates airflow through the textile layer and across the recesses 18, reducing drag and increasing the aerodynamic performance of the tennis ball 10. The lower drag can result in greater travel distance and/or greater net height of the tennis ball 10. Such improved aerodynamic performance is preferred by many players, and may prolong the life of the tennis ball 10. The lower drag characteristics of the tennis ball, alone or in combination with other modifications, may further facilitate the development of pressure-less tennis balls.

In many implementations, the tennis ball is produced in accordance with specifications of the U.S. Tennis Association (USTA.) and the International Tennis Federation (ITF). For example, the tennis ball can be produced in accordance with the following specifications.

Size: The size of the ball is tested using two ring gauges having internal diameter of 6.54 cm (2.54 inches) and 6.86 cm (2.70 inches). The tennis ball, when tested, must pass through the larger ring gauge and be unable to pass through the smaller ring gauge to meet the size requirements.

Weight: The weight of the ball is measured on a scale that is calibrated to +/−0.01 grams. The acceptable weight of the tennis ball is between 56.0 grams and 59.4 grams.

Deformation: The deformation of the tennis ball is measured using either a Stevens Machine (manually operated) or an automatic compression machine. The deformation of the ball is measured under a load of 80.07N (18 lb.) after a 15.57N (3.5 lb.) preload has been applied. The deformation of the ball is required to be between 0.56 cm (0.220 inches) and 0.74 cm (0.291 inches).

Rebound: The rebound of the ball is measured by dropping the ball vertically from a height of 254 cm (100 inches) and measuring the rebound of the tennis ball. The rebound height of the tennis ball should be from 135 cm (53 inches) to 147 cm (58 inches).

Referring to FIG. 1C, in another implementation, the textile layer 14 can extend over the outer surface 16 of the core 12 in a manner that forms voids 20 where the textile layer 14 overlays the recesses 18. Similar to the implementation of FIG. 1B, the outer textile layer 14 facilitates airflow through the textile layer and across the recesses 18 and across the voids 20, reducing drag and increasing the aerodynamic performance of the tennis ball 10. The lower drag can result in greater travel distance and/or greater net height of the tennis ball 10. In the implementation of FIG. 1C, the outer layer 14 can formed of a woven felt.

In one implementation, core 12 may be formed from a rubber or rubber-like material. In one implementation, core 12 is formed from two semi spherical halves or half shells which are molded and joined and bonded together with an adhesive, such as a natural rubber or synthetic rubber adhesive. In one implementation, the two semi spherical halves or half shells are joined in a pressure chamber so that the interior of the joined halves is pressurized. A pressurized tennis ball 10 can have an internal pressure of approximately 10 to 15 psi. In other implementations, core 12 may be formed in other manners. In some implementations, core 12 may additionally incorporate a valve that facilitates pressurization of the interior of core 12.

Figure 2B:
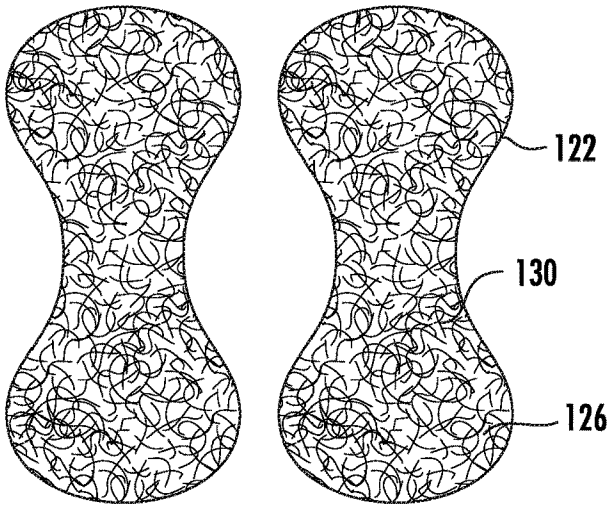
FIG. 2B is a back side view of a pair of dog-bone shaped cover panels for another example tennis ball.
Figure 2A:
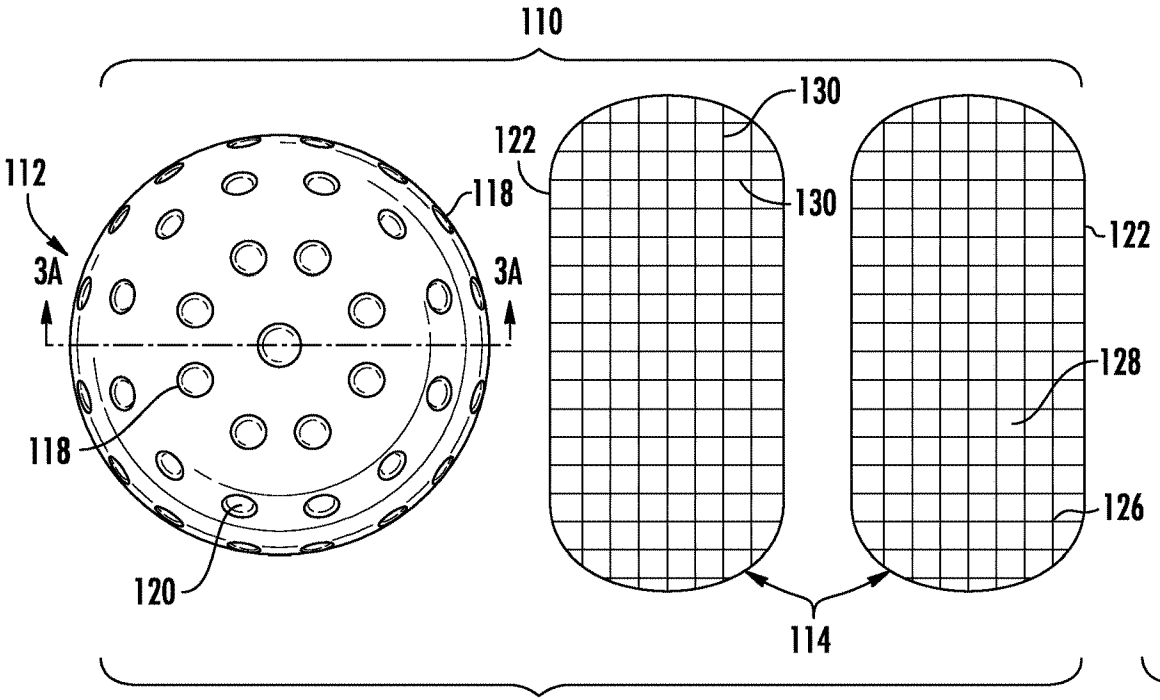
FIG. 2A is an exploded view of another example tennis ball.

In the example illustrated, outer textile layer 14 comprises two inter-nested stadium-shaped (ovular) panels 22 of the textile material, bonded along seams 24. In other implementations, such as shown in FIG. 2A, the cover panels 22 can be dog bone shaped. In other implementations, outer textile layer 14 may be provided by panels having other shapes. In some implementations, textile layer 14 may be formed by fibers not provided in the form of panels, but which are individually joined or bonded to core 12.

In one implementation, tennis ball 14 may be formed by bathing or coating core 12 in an adhesive, such as a synthetic or natural rubber adhesive. In such an implementation, the outer edges of at least one of the two dog-bone shaped panels of textile material are coated with an adhesive, such as a synthetic or natural rubber adhesive. The dog-bone shaped panels are then applied over and to the core with the edges of the dog-bone shaped panels in abutment or close proximity, while the adhesives are in an adhesive state. To form the tennis ball shown in FIG. 1. The adhesive is then allowed to dry or cure. In one implementation, the adhesive applied to the outer surface of the core 12 does not extend within the voids 20. In yet another implementation, the adhesive applied over core 12 may extend within to the recesses 18.

In one implementation, tennis ball 10 conforms to the United States Tennis Association (USTA) specifications and regulations. For example, in one implementation, tennis ball 10 may have a substantially smooth outer surface and have a diameter of between 2.57 inches and 2.7 inches. In one implementation, the textile layer may comprise a wool or a wool/nylon mixture. In one implementation, textile layer 14 is formed by woven fibers. In another implementation, textile layer 14 is formed by needle punched fibers.

In one implementation, outer textile layer 14 has a thickness of between 2 and 4 mm, and nominally 3 mm. In one implementation, outer textile layer 14 has a thickness of approximately 3 mm and comprises a mixture of 80% wool and 20% nylon felt. In one implementation, the felt has a cotton scrim layer.

Figure 3B:
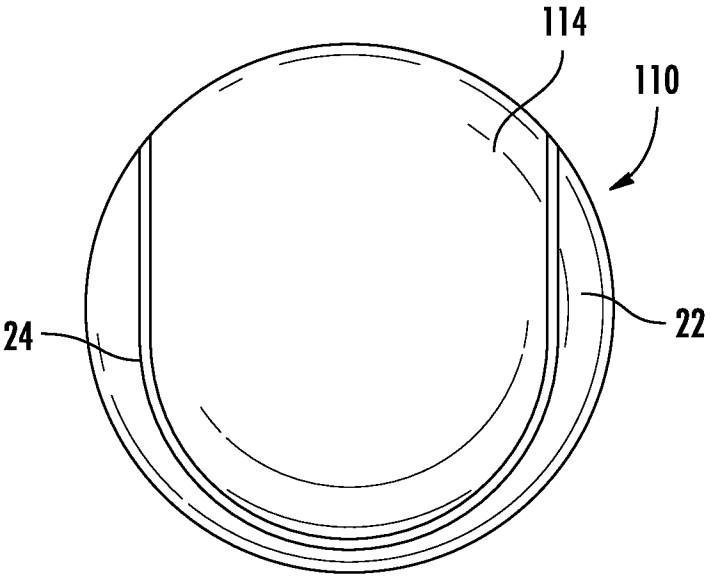
FIG. 3B is a side view of the tennis ball of FIG. 2 formed with woven felt.
Figure 3A:
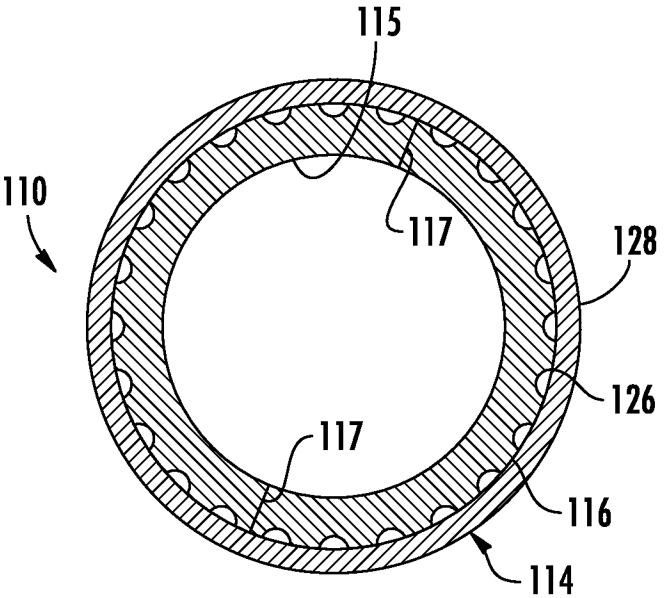
FIG. 3A is a sectional view of the tennis ball of FIG. 2.
Figure 4:
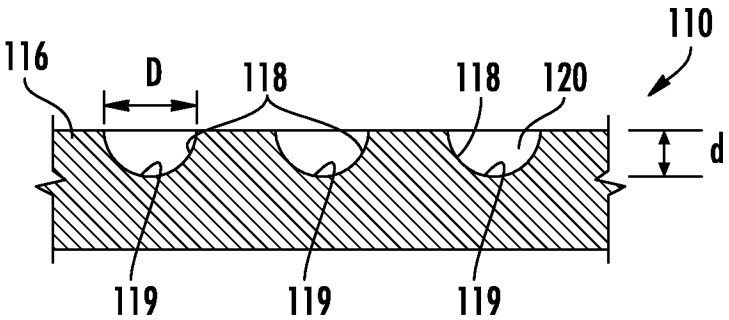
FIG. 4 is a fragmentary sectional view of a portion of a core of the tennis ball of FIG. 3.

FIGS. 2A, 3A, 3B and 4 illustrate tennis ball 110, an example implementation of tennis ball 10. FIG. 2A is an exploded view of tennis ball 110 while FIGS. 3 and 4 are sectional views of tennis ball 110. Tennis ball 110 comprises a hollow elastic or elastomeric circumferential core 112 and textile outer layer 114.

Core 112 comprises a hollow sphere having a hollow interior 115 bounded by a spherical wall 116. Core 112 is substantially the same as core 12. In one implementation, wall 116 of a pressurized ball has a thickness of at least 3.0 mm and no greater than 4.0 mm. In another implementation, the wall of a pressureless ball can have a thickness within the range of 3.8 mm to 5.2 mm. In another implementation, the wall 116 of the tennis ball 110 can be within the range of 3.0 to 5.2 mm, and the core 112 can be fully pressurized, pressureless, or slightly pressurized. In the example illustrated, wall 116 is formed from two semi spherical halves or half shells adhered, welded or otherwise joined to one another along seams 117.

In the example illustrated, the exterior surface of wall 116 comprises an array of craters or dimples 118 which are spaced from one another and are located about the entire circumferential surface of core 112. FIG. 4 is an enlarged fragmentary sectional view of a portion of wall 116 illustrating three of such dimples 118. Dimples 118 provide voids in the form of recesses, pockets or cavities in the outer surface of wall 116. In one implementation, dimples 16 are uniformly spread out and distributed across the circumferential surface of core 112. In one implementation, the core 112 includes 74 dimples 118 having a dimple radius of 2.6 mm and a diameter of 5.2 mm. In one particular implementation, each half shell of the ball core 112 can include 37 dimples resulting in the total of 74 dimples. The inside diameter of the tennis ball core can be adjusted from a standard inside diameter of approximately 54.2 mm to a diameter of 53.8 mm to account for the volume decrease associated with the dimples to maintain the overall material volume and weight of the tennis ball core. In other implementations, other numbers of dimples can be utilized. In other implementations, the dimples 118 may have predefined patterns or arrangements along the circumferential surface of core 112. Although dimples 118 are illustrated as comprising semi-spherical cavities or depressions, in other implementations, dimples 118 may have other geometries. For example, dimples 118 may alternatively comprise depressions that are semi-oval, cuboid or in the shape of pyramid. Although dimples 118 are illustrated as having a uniform width and depth, in other implementations, dimples 118 may have varying widths and depths amongst the different dimples.

The dimples 118 can have a depth, d, in the range of 1.0 to 7.0 mm, and a width or diameter within the range of 3.0 to 10.0 mm. In one implementation, the dimples 118 are circular having a depth, d, that is ½ the size of the diameter of the dimple 118. In one implementation, each of dimples 118 has a depth d of 2.6 mm, equivalent to the radius of the dimple, and a width, W, of 5.2 mm equivalent to the diameter of the dimple 118. In one implementation, dimples 118 cover extend over a surface area of the core that is within the range of 1000 to 5000 $mm^2$. In another implementation, the dimples 118 extend over a surface area of the core that is approximately 1614 $mm^2$. In one implementation, dimples 118 cover at least 13.5 percent of the total surface area of core 112. In another implementation, the dimples 118 can extend over a percentage of the total surface area of the core within the range of 9 to 43 percent. The spacing, size, depth and surface coverage of dimples 118 enhances the reduction of drag while the same time reducing the extent to which the coefficient of restitution and bounce consistency of ball 110 altered.

Textile outer layer 114 comprise a layer of textile material positioned on core 112 and extending over each of dimples 118. In one implementation, the textile layer 114 fills in and follows the contour of the outer surface of the wall 116 including the dimples 118 (FIG. 1B). In another implementation, the textile layer 114 bridges across the interior of each of the dimples 118 to form voids 120, similar to a lid or cap such that textile layer 114 does not contact floor 119 of each of dimples 118 (FIG. 1C). As a result, the hollow interior of each of dimples 118 is maintained, forming an enclosed volume bounded by the material of core 112 and the material or materials of textile layer 114. In other implementations, the outer textile layer 114 may partially fill the recesses. In other implementations, one or more recesses may be filled, and one or more of the recesses may be bridged resulting in the formation of one or more voids 120.

As shown by FIG. 2A, in the example illustrated, textile layer 114 can be provided by a pair of stadium shaped panels 122. FIG. 2A illustrates the backside of each of panels 122, the side or face that is positioned in contact with and against core 112 and over each of dimples 118. Each of panels 122 comprises a scrim layer 126 and a textile or fabric mat layer 128. Scrim layer 126 comprises a grid which serves as a backing or base for supporting the mat layer 128. In the example illustrated, scrim layer 126 comprises interlaced bars 130. In other implementations, the scrim layer 126 can take other patterns such as angled, parallel line, parallel lines, angled interlaced lines, randomly arranged lines, a plurality of curved lines and combinations thereof. FIG. 2B illustrates another implementation of cover panels 122 in which the cover panels 122 are dog-bone shaped and the bars 130 are randomly arranged about the inner surface of the panels 122 and about the scrim layer 126.

As shown by FIG. 3A, scrim layer 126 bridges across and over the voids of dimples 118 such that the interior of such voids are radially inward of the lower or innermost surfaces of scrim layer 126. The spherical plane containing scrim layer 126 extends over and above the hollow interior of voids 120 of dimples 118, wherein the voids 120 of dimples 118 are distinct and separate from any interior spacing between the interlaced individual bars 130 of the grid forming scrim layer 126. In other implementations, panels 122 may omit scrim layer 126. In other implementations, panels 122 may have other shapes and constructions. In another implementation (such as shown in FIG. 1B, for example), the layer 114 does not bridge the dimple 118 but follows the contour of the dimple and therefore the cover layer 14 fills the void or space formed by the dimple 18.

Figure 3C:
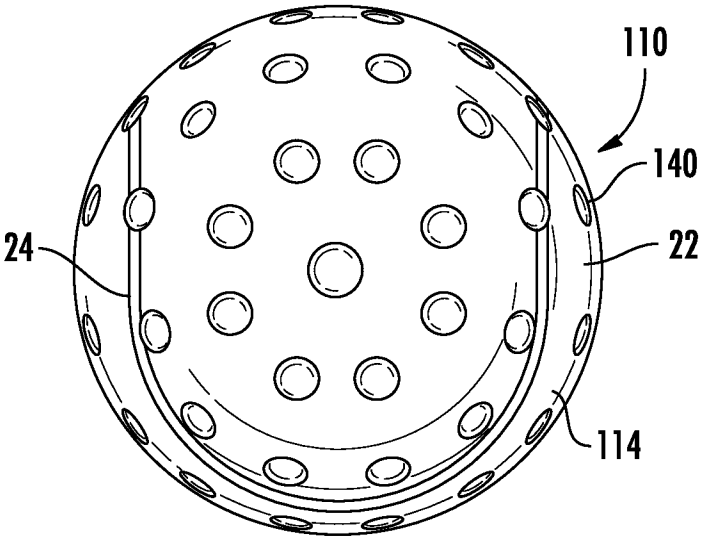
FIG. 3C is a side view of the tennis ball of FIG. 2 formed with needle-punch felt.

FIG. 3B illustrates the tennis ball 110 of FIG. 2A with the layer 114 being formed of woven felt. When woven felt is used as the layer 114, the tennis ball 110 retains a traditional appearance. FIG. 3C illustrates the tennis ball 110 of FIG. 2A with the layer 114 formed of needle-punch felt. When needle-punch felt is used as the layer 114, the needle-punch felt follows the contour of the outer surface of core 112 and therefore slight depressions 140 can be seen in the exterior or outer surface of the tennis ball 110. Accordingly, the tennis ball 110 formed with needle-punch felt provides an aesthetically pleasing, non-traditional slightly dimpled appearance, which is desired by or attractive to some users. The depressions 140 correspond to the dimples 118. In other implementations, the depressions will correspond to the shape of the recesses or depression. So, if the recesses or depressions are channels or grooves, the depressions will resemble or correspond to such channels or grooves.

Textile or fabric mat layer 128 comprises a layer of material secured to scrim layer 126. In one implementation, layer 128 comprises a felt. In one implementation, layer 128 has a thickness of approximately 3 mm and comprises a mixture of 80% wool and 20% nylon felt. In one implementation, layer 128 is 100% wool. In one example implementation, the layer 128 is formed of 65% wool and 35% synthetic wool (such as nylon). In another example implementation, the layer 128 can be formed of 50% wool and 50% synthetic wool. In another example implementation, the layer 128 can be formed of 100% synthetic wool. In still other implementations, other percentages of wool and synthetic wool materials can be used. In one implementation, layer 128 is formed by woven fibers. In another implementation, layer 128 is formed by needle punched fibers. In one implementation, layer 128 comprises a felt of wool or the mixture of wool and nylon while scrim layer 126 is made from cotton.

Figure 5B:
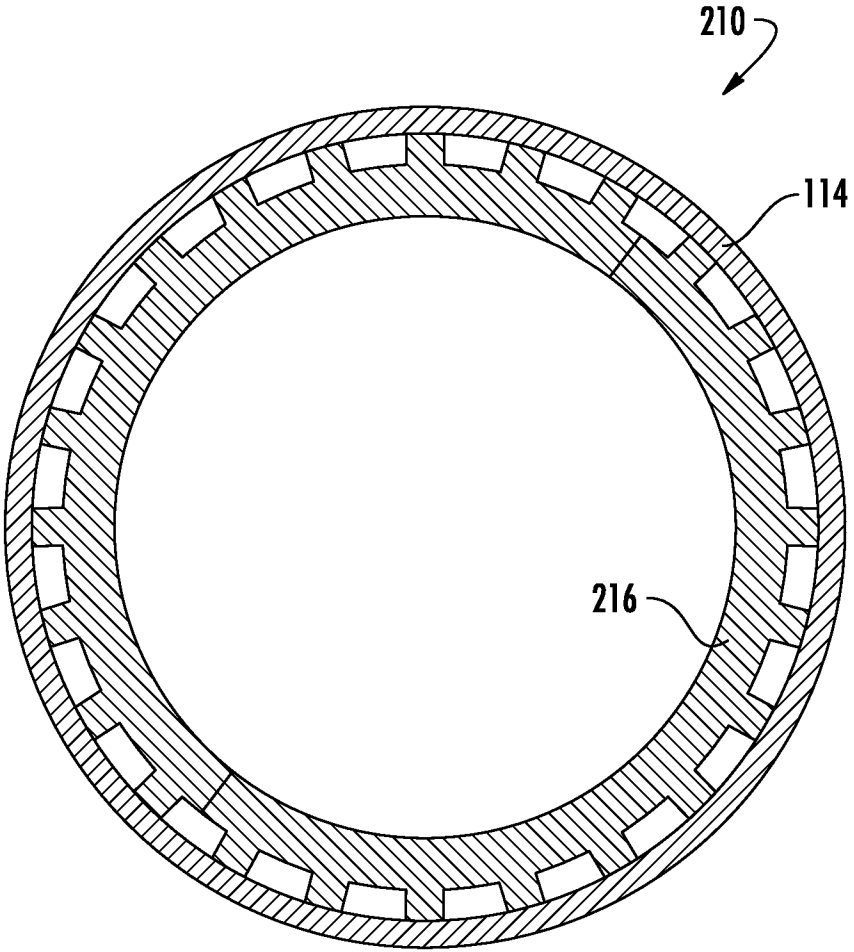
FIG. 5B is a sectional view of the tennis ball of FIG. 5A.
Figure 5A:
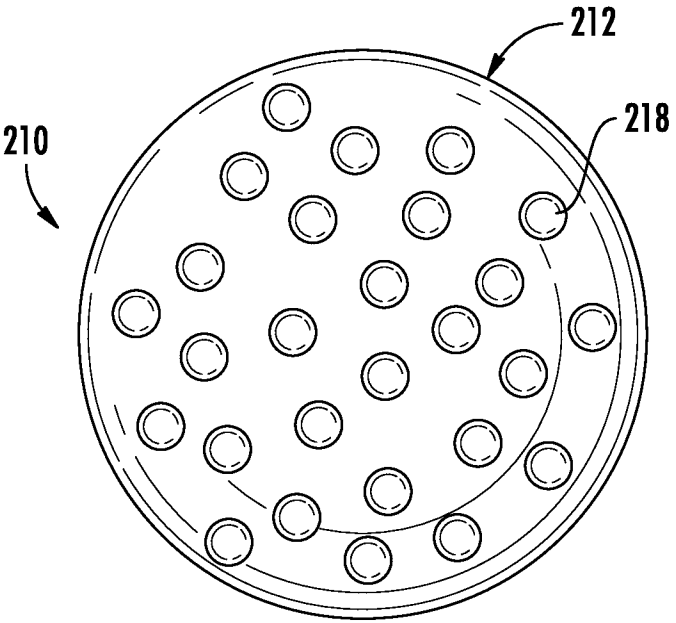
FIG. 5A is a side view of an example core of another example tennis ball.
Figure 7:
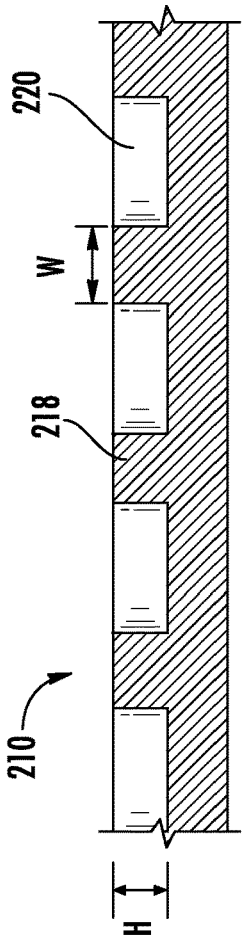
FIG. 7 is a fragmentary sectional view of a portion of the core of FIG. 5.

FIGS. 5A, 5B and 7 illustrate tennis ball 210, another example implementation of tennis ball 10. Tennis ball 210 is similar to tennis ball 110 and tennis ball 10 except that tennis ball 210 comprises elastic or elastomeric spherical core 212 in place of core 112. Those remaining components of tennis ball 210 which correspond to components of tennis ball 10 or tennis ball 110 are numbered similarly.

Core 212 is similar to core 112 except that the core 212 includes projections 218 rather than dimples 118. In the example implementation of FIGS. 5A and 5B, the projections 218 are shaped as columns or pillars 218. Pillars 218 support overlying portions of textile outer layer 114 (described above). Although pillars 218 are illustrated as generally cylindrical protuberances rising up and projecting from the wall 216 of core 212, in other implementations, pillars 218 may have other shapes such as column having polygonal cross-sectional shapes, hemispherical shapes, irregular curved shapes, semi-ovular shapes, and combinations thereof.

In one implementation, pillars 218 are uniformly spread out and distributed across the circumferential surface of core 112. In other implementations, pillars 218 may have predefined patterns or arrangements along the circumferential surface of core 212. Although pillars 218 are illustrated as having a uniform width and height, in other implementations, pillars 218 may have varying widths and depths amongst the different pillars.

The number, size and shape of the projections or pillars can be varied. In one implementation, each of pillars 218 has a height H within the range of 1.0 to 3.0 mm. In one implementation, each of pillars 218 additionally or alternatively has a diameter or width W within the range of 2 to 4 mm. In one implementation, pillars 218 extend over 6 to 55 percent of the outer surface of the core 212. In one implementation, the pillars 218 can extend over 6.4 to 13.4 percent of the outer surface of the core 212. In another implementation, the pillars can extend over 12.7 to 26.8 percent of the outer surface of the core 212. In another example implementation, the pillars can extend over 25.6 to 53.5 percent of the outer surface of the core 212. In other implementations, other pillars can extend over other ranges or amounts of the surface area of the core. In one implementation, the pillars 218 can extend over a range of 78 to 6312 $mm^2$. In other implementations, the pillars or projections can extend over other amounts of the surface area of the core. The spacing, size, height and surface coverage of pillars 218 enhances the reduction of drag while at the same time reducing the extent to which the coefficient of restitution and bounce consistency of ball 210 is altered.

Figure 6B:
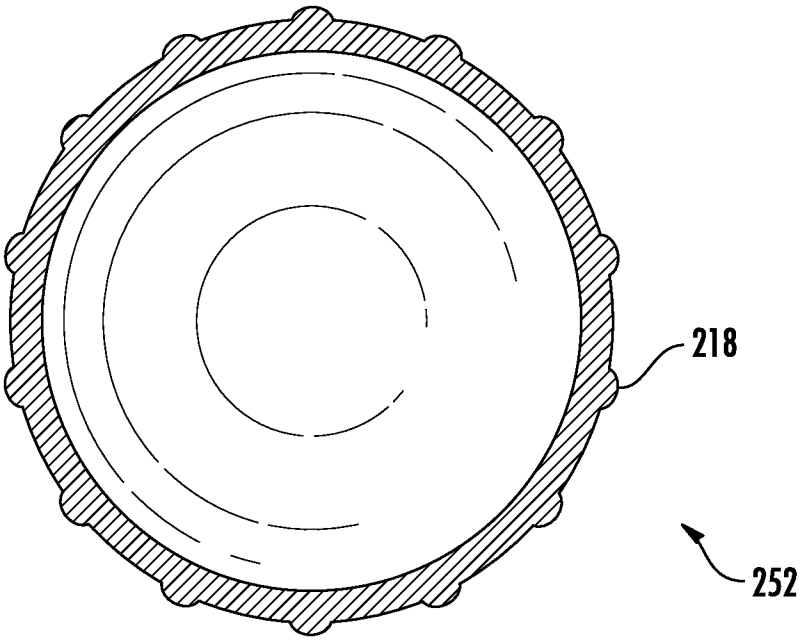
FIG. 6B is a sectional view of the tennis ball taken about line 6B-6B of FIG. 6A.
Figure 6A:
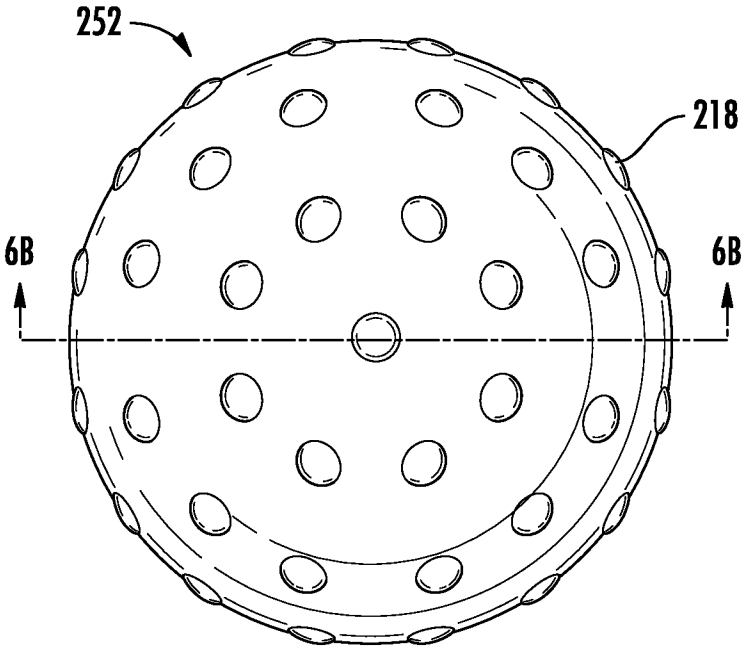
FIG. 6A is a side view of an example core of another example tennis ball.

FIGS. 6A and 6B illustrate another example implementation of tennis ball 10. Core 252 is similar to core 212 except that the projections 218 are generally spherical projections or rounded bumps or pebbles 218 extending above the outer surface of wall 216. The projections 218 support layer 114. In one implementation, the number of projections can be 74 with each projection having a radius of 0.97 mm extending outward from the surface of the tennis ball core—37 projections on each half-shell arranged in rows on the surface of the tennis ball core. The inside diameter of the core can be increased from the standard of 54.2 mm to 54.4 mm to offset the volume increase associated with the projections to maintain the overall material volume in the tennis ball core. In other implementations, the number, size, shape and distribution of the projections about the core 252 can be varied.

Figure 8:
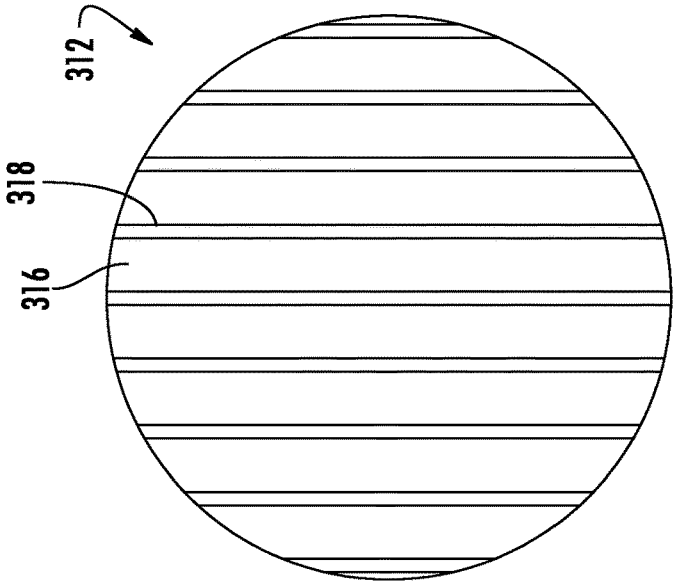
FIG. 8 is a side view of another example tennis ball core.
Figure 9C:
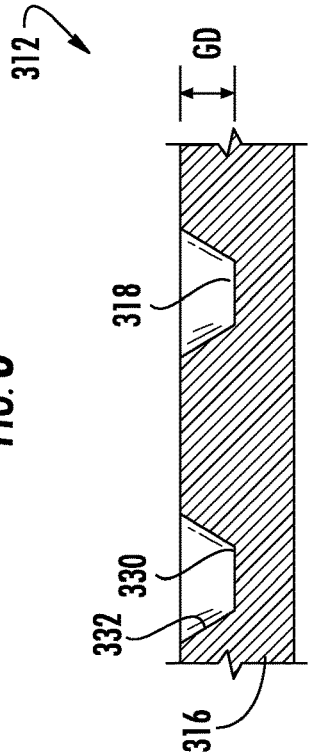
FIGS. 9B and 9C are fragmentary sectional views of alternative implementations a portion of the tennis ball core of FIG. 8.
Figure 9A:
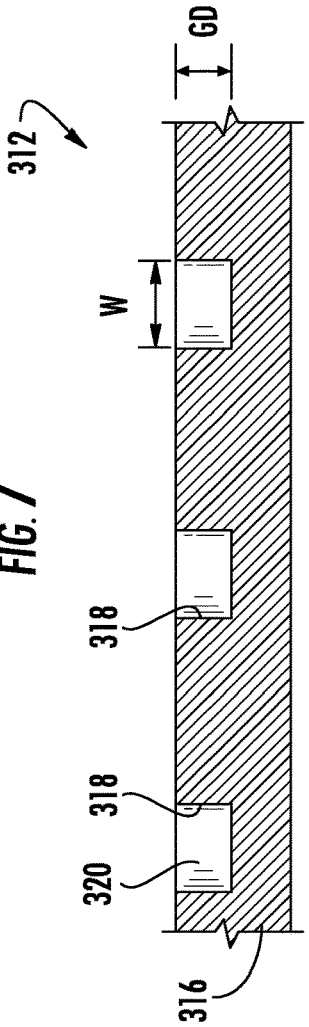
FIG. 9A is a fragmentary sectional view of a portion of the tennis ball core of FIG. 8.

FIGS. 8 and 9A illustrate tennis ball core 312, another example implementation of tennis ball core 12 described above. Tennis ball core 312 may be employed in any of the tennis balls described in this disclosure. Core 312 comprises a hollow sphere having a hollow interior bound by a wall 316. Wall 316 is formed from a rubber or rubber-like material. In one implementation, wall 316 has a thickness within the range of 3.0 to 5.2 mm. In one implementation, the wall thickness of the core can be within the range of 3.0 to 4.0 mm. In another implementation, the wall thickness of the core can be within the range of 3.8 to 5.2 mm.

As with cores 112 and 212, core 312 has an irregularly shaped outer surface that supports the overlying textile layer 114 and includes recesses defined by the core. As described above, cores 212, 312 define voids 220, 320 within the interior dimples. Core 312 defines a plurality of channels or grooves 318 cutting into or extending into exterior service of wall 316 of core 312.

In one implementation, grooves 318 are uniformly spread out and distributed across the circumferential surface of core 312. In other implementations, grooves 318 may have predefined patterns or arrangements along the circumferential surface of core 312. For example, the grooves 318 can extend parallel to each other such that the grooves are spaced apart from each other. Although grooves 318 are illustrated as having rectangular cross-sections, in other implementations, grooves 318 may have other geometries. For example, grooves 318 may alternatively comprise grooves having semi oval, semi spherical, semi-circular, semi-rectangular, triangular, V-shaped, C-shaped or other geometrical or curved shaped cross-sections. Although grooves 318 are illustrated as having a uniform width and depth, in other implementations, grooves 318 may have varying widths and depths amongst the different dimples.

Figure 9B:
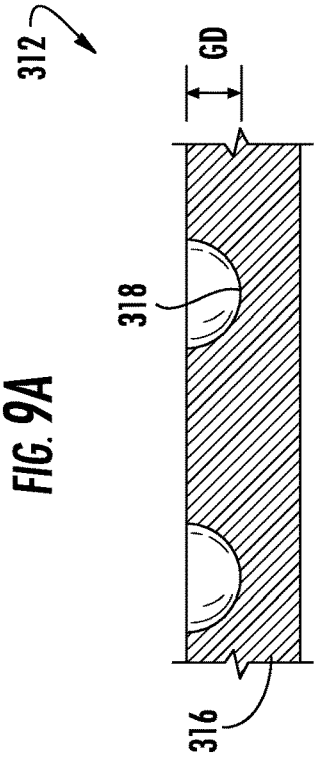

As shown in FIG. 9A, in one implementation, each of grooves 318 has a rectangular shape with a groove depth GD within the range of 1 to 3 mm. In one implementation, each of grooves 318 additionally or alternatively has a width W within the range of 1 to 4 mm. In other implementations, the grooves can vary in number, shape, size and/or depth. In one example implementation as shown in FIG. 9B, the grooves can have a semi-circular or semi-ovular cross-sectional shape. In another example implementation as shown FIG. 9C, the grooves can have a trapezoidal cross-sectional shape. In one example implementation, the trapezoidal shaped channel has a small bottom surface or base 330 with a width of approximately 1.61 mm and a width at a mouth 332 or top surface of the trapezoidal shaped channel of approximately 3.27 mm. In other implementations, other sizes and size ratios can be used for the trapezoidal channels.

In one implementation, the number of grooves 318 can number from 2 to 16. The grooves 318 can extend about the entire circumference of the core 312. The grooves 318 can extend over 3.2 to 80.4 percent of the total surface area of the core 312. Each groove 318 can extend over a surface area within the range of 192 to 796 $mm^2$ depending upon the width (widths between 1 to 4 mm) of the groove 318. In other implementations, other areas and widths of the grooves 318 can be used. The spacing, size, height and surface coverage of grooves 318 enhances the reduction of drag while the same time reducing the extent to which the coefficient of restitution and bounce consistency of the tennis ball employing core 312. The size, spacing, number and shape of the grooves 318 can be varied as desired.

Figure 10:
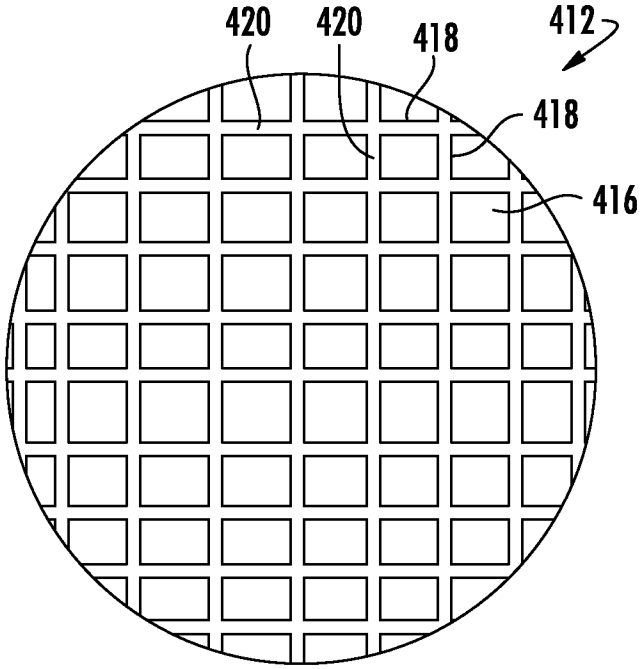
FIG. 10 is a side view of another example tennis ball core.

FIG. 10 illustrates core 412, another example implementation of tennis ball core 12 described above. Tennis ball core 412 may be employed in any of the tennis balls described in this disclosure. Core 412 comprises a hollow sphere having a hollow interior bounded by a wall 416. Wall 416 is formed from a rubber or rubber-like material. In one implementation, wall 416 has a thickness within the range of 3.0 to 5.2 mm.

As with cores 112 and 212, core 412 has an irregularly shaped outer surface that supports the overlying textile layer 114. Like core 312 described above, core 412 defines a plurality of channels or grooves 418 cutting or extending into exterior service of wall 416 of core 412. FIG. 10 illustrates a different pattern for such grooves, wherein core 412 comprises crisscrossing channels or grooves 418 that can define a recessed region or void 420. Each of grooves 418 may be similar to grooves 318 described above with respect to core 312. The crisscrossing of the grooves 418 may provide enhanced drag reduction and may enhance bounce consistency or uniformity.

In some implementations, grooves 418 may have different depths and/or widths amongst the different grooves. For example, of grooves in one direction may have a different depths and/or different with as compared to grooves extending in a different direction. Grooves extending in one direction may have different depths and/or widths. In some implementations, the depth and/or width of an individual group may vary along its length. In some implementations, grooves 418 in core 412, as well as grooves 318 in core 312, may be zigzagged or wavy rather than extending about the core in a linear fashion.

Figure 11A:
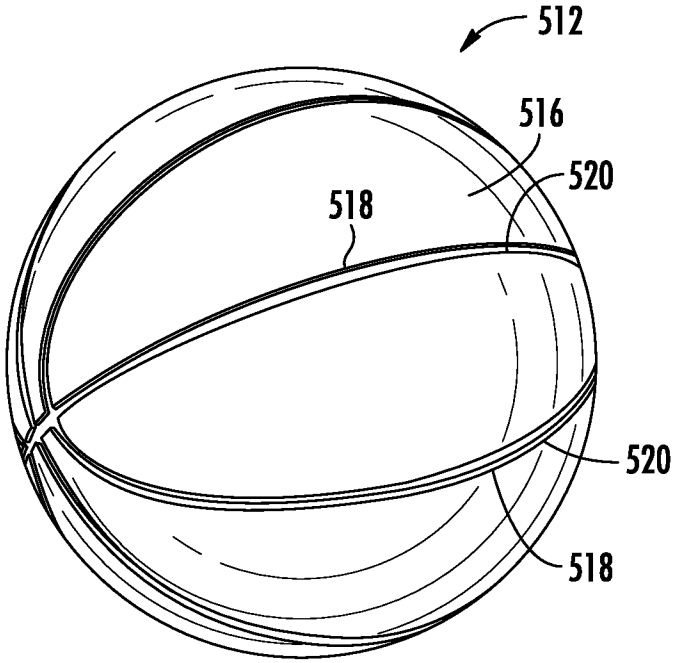
FIG. 11A is a perspective view of another example tennis ball core.
Figure 11C:
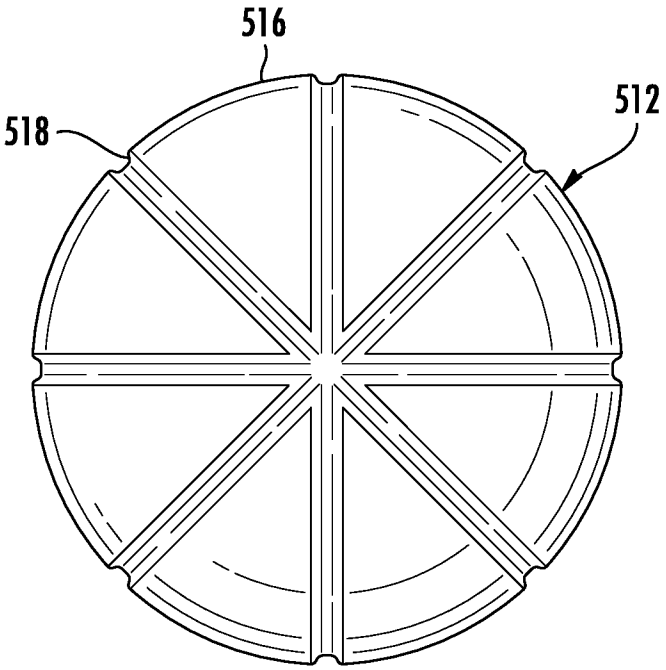
FIG. 11C is an end view of the example tennis ball core of FIG. 11B.
Figure 11B:
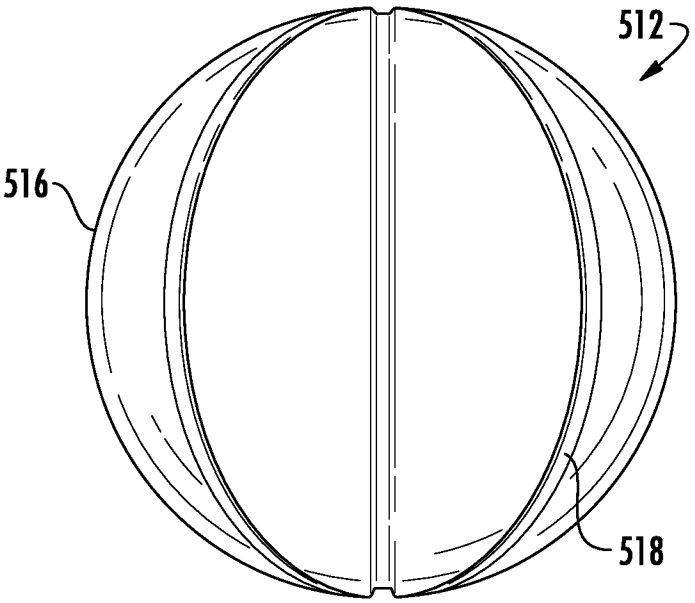
FIG. 11B is a side view of another example tennis ball core.

FIGS. 11A, 11B and 11C illustrate two examples of core 512, other example implementations of core 12. Tennis ball core 512 may be employed in any of the tennis balls described in this disclosure. Core 512 comprises a hollow sphere having a hollow interior bound by a wall 516. Wall 516 is formed from a rubber or rubber-like material.

As with cores 112, 212 and 312, core 512 has an irregularly shaped outer surface that supports the overlying textile layer 114. Like core 412 described above, core 512 defines a plurality of channels or grooves 518 cutting into our extending into exterior surface of wall 516 of core 512. The grooves 518 can define a recessed volume or void 520. FIG. 11A illustrates a different pattern for such grooves, wherein core 512 comprises channels or grooves 518 defining a pattern similar to the pattern of channels of a conventional basketball. In the implementation of FIGS. 11B and 11C, 8 channels extend from the pole of a first half shell of the core 412 to the equator of the half shell and the second half shell continues the channels extending from the equator to the pole of the second half shell of the core 412. Each of the channels can be located so as to extend from the pole 45 degrees apart from each other, and spaced equidistantly along the equator of the half shell. The inside diameter of the tennis ball core can be adjusted from a standard inside diameter of approximately 54.2 mm to a diameter of 53.8 mm to account for the volume decrease associated with the dimples to maintain the overall material volume and weight of the tennis ball core. Each of grooves 518 may be similar to grooves 318 described above with respect to core 312. The pattern of grooves 518 may provide enhanced drag reduction and may enhance bounce consistency or uniformity. In other implementations, other patterns of channels or grooves can be used.

Analysis of Tennis Balls Made in Accordance with Implementations of: FIG. 2A (Example Pattern 1), FIGS. 6A&B (Example Pattern 3), and FIGS. 11B&C (Example Pattern 2)

Tennis balls were molded with core and felt combinations as indicated below. Rubber for a standard pressurized tennis ball was compounded using the following rubber composition:

TABLE 1

| No. | Ingredient | SP · GR | PHR |
|---|---|---|---|
| | Core Compound | | |
| 1 | RSS #1 | 0.93 | 100 |
| 2 | Magnesium Carbonate | 2.2 | 26.39 |
| 3 | Calcium Carbonate | 2.7 | 29.17 |
| 4 | Hi-Sil 255 | 2.0 | 17.5 |
| 5 | Zinc Oxide | 5.6 | 9.72 |
| 6 | Stearic Acid | 0.94 | 1.30 |
| 7 | SP-P | 1.25 | 2.00 |
| 8 | Aktiol | 1.59 | 1.72 |
| 9 | PVI | 1.33 | 0.80 |
| 10 | DPG | 1.13 | 0.63 |
| | Total | | 189.23 |
| | Chemical Mixing | | |
| 1 | S-25 (Sulfur) | 2.07 | 5.17 |
| 2 | DM | 1.5 | 0.825 |
| 3 | CBS | 1.5 | 0.675 |
| 4 | DPG | 1.13 | 0.51 |
| | Total | 1.295 | 7.18 |

The compounds were molded into half-shells having a thickness of ~3.6 mm, and shells were molded together in a pressurized mold to form pressurized tennis ball cores. The cores were molded having an internal pressure of ~12-14 psi.

Tennis ball cores were then covered with felt. Tennis cores comprising the various surface patterns were molded with both woven felt and needle-punch felt. Woven felt is used primarily for higher quality, tournament level tennis balls and needle-punch felt is used primarily for other levels of tennis balls. Felt used on balls molded with the surface patterns illustrated above are as follows:

3336 Woven Felt—Woven felt comprising ~65% natural wool fiber and ~35% synthetic fiber.

3453 Needle-Punch Felt—Needle-Punch felt comprising ~50% natural wool fiber and ~50% synthetic fiber.

Standard pressurized tennis balls were molded and covered with woven felt as follows:

Example 1

Core pattern 1 (74 dimple pattern) with 3336 woven felt.

Example 2

Core pattern 2 (8 channel pattern) with 3336 woven felt.

Example 3

Core pattern 3 (74 projection pattern) with 3336 woven felt.

Examples 1-3 were tested and compared to Wilson U.S. Open tennis ball—the Wilson® US Open tennis ball comprising a core molded having smooth spherical surface and covered using woven felt grade 3336.

Standard pressurized tennis balls were also molded and covered with needle-punch felt as follows:

Example 4

Core pattern 1 (74 dimple pattern) with 3453 needle-punch felt.

Example 5

Core pattern 2 (8 channel pattern) with 3453 needle-punch felt.

Example 6

Core pattern 3 (74 projection pattern) with 3453 needle-punch felt.

Examples 4-6 were tested and compared to Wilson® Championship tennis ball—the Wilson® Championship tennis ball comprising a core molded having a smooth spherical surface and covered using needle-punch felt grade 3453.

Balls that were produced using Core Surface patterns 1-3 and 3336 woven felt were measured for physical properties (size, weight, deformation and rebound).

TABLE 2

Tennis Balls with Core Surface Patterns - Woven Felt - Physical Properties

| Ball | Size (in.) | Weight (g) | Deform. (in.) | Rebound (in.) |
|---|---|---|---|---|
| Example 1 (74 dimple pattern 1) | 2.633 | 57.4 | 0.252 | 57.5 |
| Example 2 (8 channel pattern 2) | 2.643 | 59.4 | 0.239 | 57.9 |
| Example 3 (74 projection pattern 3) | 2.653 | 59.4 | 0.225 | 58.4 |
| U.S. Open ® control | 2.630 | 57.4 | 0.252 | 55.8 |

Examples of the experiment have physical properties as follows:

The tennis balls of Example 1 exhibit all properties within USTA/ITF specifications. The tennis balls of Example 1 exhibit comparable deformation and weight compared to U.S. Open control ball.

The tennis Balls of Example 2 exhibit all properties within USTA/ITF specifications. The balls of Example 2 exhibit lower deformation (stiffer composition) and higher weight (~2 grams) than U.S. Open control balls.

The tennis balls of Example 3 exhibit all properties within USTA/ITF specifications. The balls of Example 3 exhibit lower deformation (stiffer construction) and higher weight (~2 grams) than U.S. Open control balls.

Overall—ball physicals of Examples 1-3 molded using woven felt are within USGA/ITF specifications.

Visual inspection of the balls molded with woven felt indicates that there is no appearance of any indentations on the surface of the tennis balls that would correspond with the indentations/projections on the surface of the core. Tennis balls of the invention molded with woven felt have the same appearance as a tennis ball molded with a conventional tennis ball core. Accordingly, the tennis balls molded with woven felt maintain the appearance of a traditional tennis ball.

Balls were tested for flight distance and coefficient of drag under set conditions using a Playmate® Grand Slam™ tennis ball machine by Metaltek of Morrisville, N.C. Ball distance and spin parameter were measured using Trackman® measuring system by TrackMan A/S of Denmark designed specifically for measuring tennis ball flight.

Balls were tested at conditions designed to simulate forehand hitting conditions as follows:

Forehand Setup: 75 mph ball velocity, 5.5° launch angle, 1800 rpm

Balls were measured for flight performance (speed, spin, length, height at net). Coefficient of drag ($C_d$) is also calculated for each ball throughout the flight by the Trackman® measuring system. Results of testing are as follows:

TABLE 3

Tennis Balls with Core Surface Patterns - Woven Felt - Flight Properties

| Ball | Speed (mph) | Spin (rpm) | Length (ft.) | Height @ Net (ft.) | $C_d$ |
|---|---|---|---|---|---|
| Example 1 (74 dimple pattern) | 74.8 | 1789 | 66.3 | 4.02 | 0.575 |
| Example 2 (8 channel pattern) | 75.2 | 1800 | 67.5 | 4.22 | 0.568 |
| Example 3 (74 projection pattern) | 75.0 | 1808 | 67.5 | 4.23 | 0.551 |
| U.S. Open ® control | 74.7 | 1842 | 65.4 | 4.17 | 0.615 |

Examples of the experiment have physical properties as follows:

The tennis balls of Example 1 exhibit slightly longer distance (1.4%) than U.S. Open control balls. The tennis ball of Example 1 also exhibits reduction in the coefficient of drag of 6.5% compared to U.S. Open control balls.

The tennis balls of Example 2 exhibit longer distance (3.2%) than U.S. Open control balls. The tennis ball of Example 2 also exhibits reduction in the coefficient of drag of 7.6% compared to U.S. Open control balls.

The tennis balls of Example 3 exhibit longer distance (3.2%) than U.S. Open control balls. The tennis ball of Example 1 also exhibits reduction in the coefficient of drag of 10.4% compared to U.S. Open control balls.

Overall, the balls molded with core surface patterns and woven felt exhibit lower coefficient of drag of 6.5% to 10.4% than U.S. Open control balls—resulting in more efficient flight and longer distance than U.S. Open balls at comparable launch testing conditions.

Balls that were produced using Core Surface patterns 4-6 and 3453 needle-punch felt were measured for physical properties (size, weight, deformation and rebound).

TABLE 4

Tennis Balls with Core Surface Patterns - Needle-Punch Felt - Physical Properties

| Ball | Size (in.) | Weight (g) | Deform. (in.) | Rebound (in.) |
|---|---|---|---|---|
| Example 4 (74 dimple pattern 1) | 2.630 | 56.1 | 0.267 | 57.1 |
| Example 5 (8 channel pattern 2) | 2.633 | 57.4 | 0.246 | 57.3 |
| Example 6 (74 projection pattern 3) | 2.620 | 57.9 | 0.244 | 57.6 |
| Wilson ® Championship ™ control | 2.623 | 57.4 | 0.234 | 57.1 |

Examples of the experiment have physical properties as follows:

The tennis balls of Example 4 exhibited all properties within USTA/ITF specifications. The tennis balls of Example 4 exhibit lighter weight, greater deformation (softer composition) and comparable rebound compared to Wilson® Championship control ball.

The tennis balls of Example 5 exhibit all properties within USTA/ITF specifications. The balls of Example 5 exhibit comparable weight, deformation and rebound compared to Wilson® Championship control balls.

The tennis balls of Example 6 exhibit all properties within USTA/ITF specifications. The balls of Example 6 exhibit comparable weight, deformation and rebound compared to Wilson® Championship control balls.

Overall—ball physicals of Examples 4-6 molded using needle-punch felt all are within USGA/ITF specifications.

Visual inspection of the balls molded with needle-punch felt indicates that there are indentations in the surface of the core that exhibit dimples, waves, etc. that correspond with the indentations/projections on the surface of the core. Tennis balls of the invention molded with needle-punch felt exhibit visible patterns of the surface of the tennis ball. The tennis balls produced in accordance with implementations of the present invention using needle-punch felt result in the depression or projections of the core being also generally reflected or shown on the outer surface of the tennis ball. For example, the tennis ball of Example 4 with 74 dimples on its core has slight depressions visible on the outer surface of the needle-punch felt in the locations of the core depressions. The slight depressions relate or correspond to the dimples in the core of the tennis ball.

Balls were tested for flight distance and coefficient of drag under set conditions using a Playmate® Grand Slam™ tennis ball machine. Ball distance and spin parameter were measured using Trackman® measuring system designed specifically for measuring tennis ball flight.

Balls were tested at conditions designed to simulate forehand hitting conditions as follows:

Forehand Setup: 75 mph ball velocity, 5.5° launch angle, 1800 rpm

Balls were measured for flight performance (speed, spin, length, height at net). Coefficient of drag ($C_d$) is also calculated for each ball throughout the flight by the Trackman measuring system. Results of testing are as follows:

TABLE 5

Tennis Balls with Core Surface Patterns - Needle-Punch Felt - Flight Properties

| Ball | Speed (mph) | Spin (rpm) | Length (ft.) | Height @ Net (ft.) | $C_d$ |
|---|---|---|---|---|---|
| Example 4 (74 dimple pattern 1) | 74.4 | 1826 | 63.6 | 3.71 | 0.541 |
| Example 5 (8 channel pattern 2) | 74.4 | 1826 | 63.9 | 3.77 | 0.538 |
| Example 6 (74 projection pattern 3) | 74.6 | 1795 | 63.5 | 3.87 | 0.540 |
| Wilson ® Championship ™ control | 74.2 | 1875 | 62.0 | 3.62 | 0.564 |

Examples of the experiment have physical properties as follows:

The tennis balls of Example 4 exhibit slightly longer distance (2.6%) than Wilson® Championship™ control balls. The tennis ball of Example 4 also exhibits reduction in the coefficient of drag of 4.1% compared to U.S. Open control balls.

The tennis balls of Example 5 exhibit longer distance (3.1%) than Wilson® Championship™ control balls.

The tennis ball of Example 5 also exhibits reduction in the coefficient of drag of 4.6% compared to U.S. Open control balls.

The tennis balls of Example 6 exhibit longer distance (2.4%) than Wilson® Championship™ control balls. The tennis ball of Example 6 also exhibits reduction in the coefficient of drag of 4.3% compared to U.S. Open control balls.

Overall, the balls molded with core surface patterns and needle-punch woven felt exhibit lower coefficient of drag of 4.1% to 4.6% compared to Wilson Championship control balls—resulting in more efficient flight and longer distance than Wilson Championship balls at comparable launch conditions.

The balls of Examples 4-6 (needle-punch felt) exhibit less of a decrease in the coefficient of drag (Ca) than Examples 1-3 (woven felt)—but in both cases the implementation of the surface patterns on the core surface results in a decrease in the coefficient of drag and increase in distance of the tennis balls compared to control balls produced with equivalent felt under comparable launch conditions.

Overall, tennis balls of the invention exhibit a decrease in the coefficient of drag which results in improved aerodynamic performance resulting in more efficient flight—longer length when hit at a comparable velocity compared to a conventional tennis ball.

Figure 12:
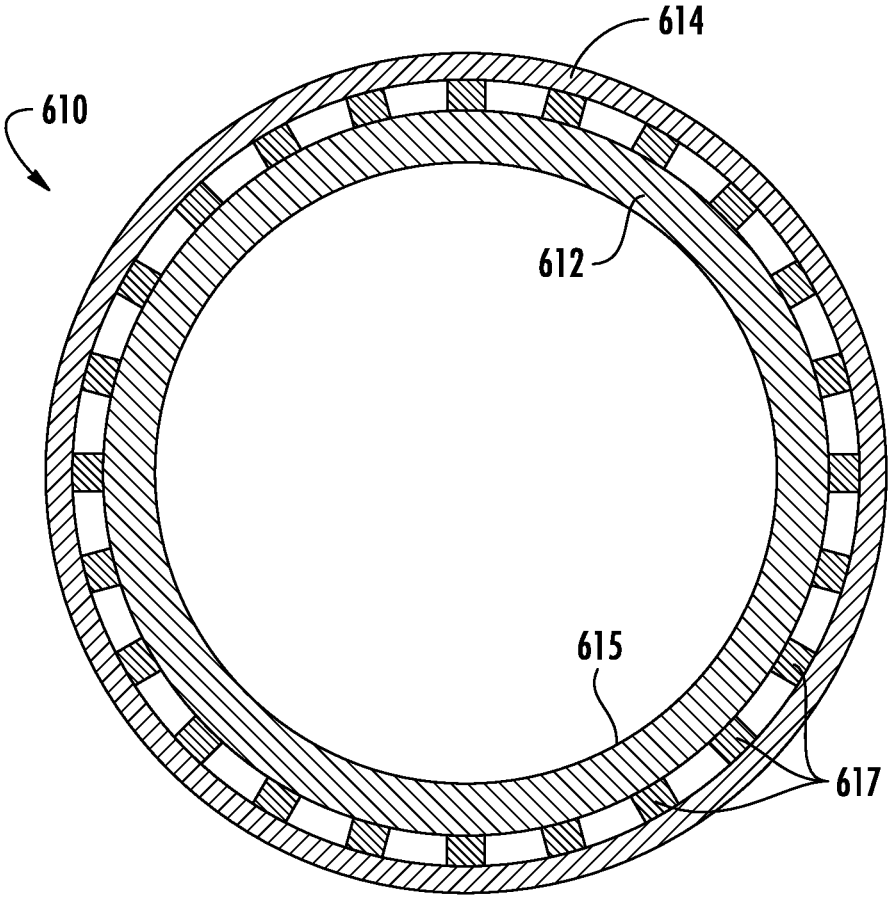
FIG. 12 is a sectional view of another example tennis ball.
Figure 13:
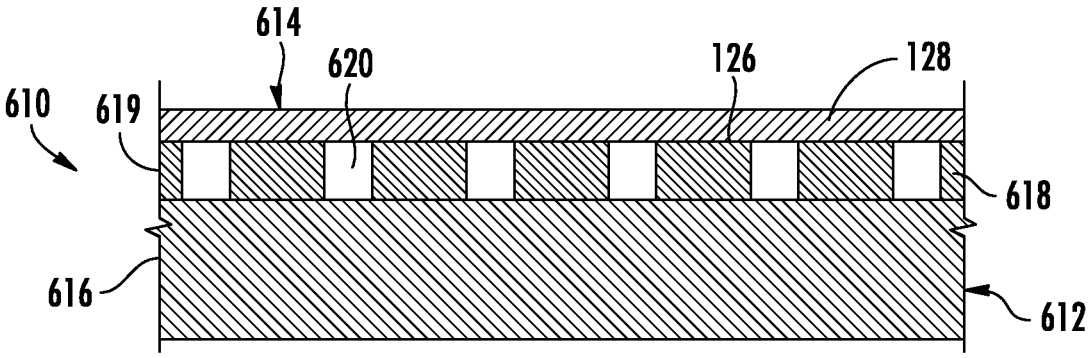
FIG. 13 is a fragmentary sectional view of a portion of the tennis ball of FIG. 12.
Figure 14:
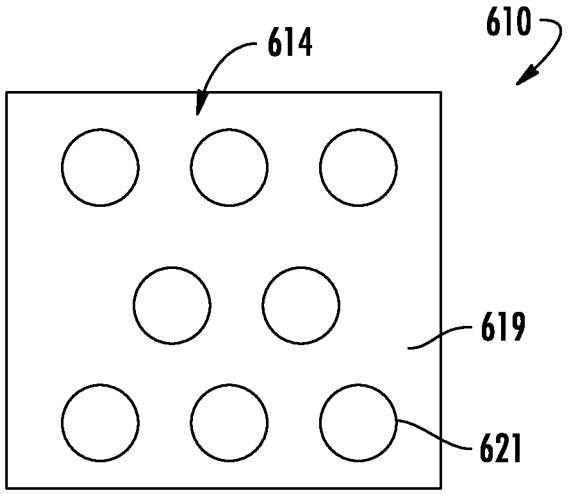
FIG. 14 is a fragmentary view of a bottom more inner portion of a textile outer layer of the tennis ball of FIG. 12.

FIGS. 12-14 illustrate tennis ball 610, another example implementation of ball 10. As with the above described tennis balls, tennis ball 610 has a substantially uniform exterior surface (but for the stadium shaped seams between panels 122), substantially maintaining the outer aesthetic appearance of the tennis ball 10 while facilitating airflow through a textile layer and across or through the voids 20, reducing drag and increasing ball speed. The lower drag results in greater travel distance and/or net height of the tennis ball after impact. Such greater travel distance and/or improves performance of the ball, is preferred by many players, and may prolong the life of the tennis ball 610. The lower drag, alone or in combination with other modifications, may further facilitate pressure-less tennis balls.

Unlike tennis balls 310-510 described above, tennis ball 610 provide such voids on the underside or inner side of the textile outer layer that extends about the core. FIG. 12 is a sectional view of tennis ball 610 while FIG. 13 is an enlarged sectional view of a portion of tennis ball 610.

Tennis ball 610 comprises core 612 and textile outer layer 614. Core 612 comprises a hollow sphere having a hollow interior 615 bound by a wall 616. Wall 616 is formed from a rubber or rubber-like material. In one implementation, wall 616 for a pressurized ball has a thickness of at least 3.0 mm and no greater than 4.00 mm, and wall 616 for a pressureless ball has a thickness of at least 3.8 mm and no more than 5.2 mm. In one implementation, wall 616 is formed from a natural rubber. In other implementations, wall 616 may be formed from natural rubber, polybutadiene, styrene-butadiene rubber, urethane rubber, chlorobutyl rubber, bromobutyl rubber and/or combinations thereof. The rubber composition of wall 616 can also comprise a composition of natural rubber and/or polybutadiene rubber which also comprises thermoplastic materials including, but not limited to, polyethylene and ethylene copolymers. In the example illustrated, wall 616 is formed from two semi spherical halves or half shells adhered, welded or otherwise joined to one another along seams 617. In the example illustrated, the outer circumferential surface of core 612 is substantially spherical and smooth. In some implementations, core 612 may alternatively be replaced by anyone of cores 112, 212, 312, 412 and 512 described above to provide even further enhanced drag reduction.

Textile outer layer 614 is similar to textile outer layer 114 described above except that textile layer 614 comprises a bottom surface or inner surface having inwardly extending or projecting protuberances 617 that space the remaining overlying portions of layer 614 over and above cavities 620 circumferentially defined between such protuberances and radially sandwiched between the remaining overlying portions of layer 614 and the exterior surface of core 612.

In one implementation, protuberances 617 comprise columns or pillars 618 provided by a layer 619 of textile material, such as a layer of felt bonded to, needle punched to or otherwise joined to the bottom side of scrim layer 126 (described above), on the opposite side of scrim layer 126 as layer 128, wherein layer 619 spaces scrim layer 126 from the exterior surface of wall 616 of core 612 and wherein layer 619 has through openings, cavities or depressions that form voids 620 which are sandwiched between scrim layer 126 and core 612.

FIG. 14 illustrates a bottom side of layer 619 of textile outer layer 614. Although pillars 618 are illustrated as generally cylindrical protuberances extending downward or inward from scrim layer 126, in other implementations, pillars 218 may have other shapes such as column having polygonal cross-sectional shapes. In some implementations, pillars 618 may comprise rounded bumps, wherein the rounded bumps support and elevate scrim layer 126 of layer 114 above the voids 620 between the bumps.

In one implementation, pillars 618 are uniformly spread out and distributed across the underside of layer 614. In other implementations, pillars 618 may have predefined patterns or arrangements along the underside of layer 614. Although pillars 618 are illustrated as having a uniform width and height, in other implementations, pillars 618 may have varying widths and depths amongst the different pillars. The spacing, size, height and surface coverage of pillars 618 enhances the reduction of drag while the same time reducing the extent to which the coefficient of restitution and bounce consistency of ball 610 is altered.

In some implementations, layer 619 forming pillars 618 and secured to scrim layer 126 may be formed from a non-textile material. For example, in some implementations, layer 619 may be formed from an elastomeric a rubber-like material, such as a polymer or rubber. In such implementations, layer 619 may additionally provide enhanced bounce or resiliency to ball 610.

In some implementations, protuberances 617 or pillars 618 may comprise posts bonded, welded to, or integrally molded as a single unitary body with scrim layer 126. For example, in some implementations, scrim layer 26 may be formed from a polymer or plastic material, wherein pillars 618 comprise posts that are molded as part of scrim layer 26 and wherein the post project from underside of scrim layer 126 at the junctions of the crisscrossing latticework of bars 126 of the polymer scrim layer 126. In some implementations, scrim layer 126 may be omitted. In such implementations, protuberance 617/pillars 618 may be formed by molding or deforming an underside of layer 128 or by partially cutting into or removing material from the underside or inner side of layer 128, prior to securing layer 128 to core 612.

Figure 15:
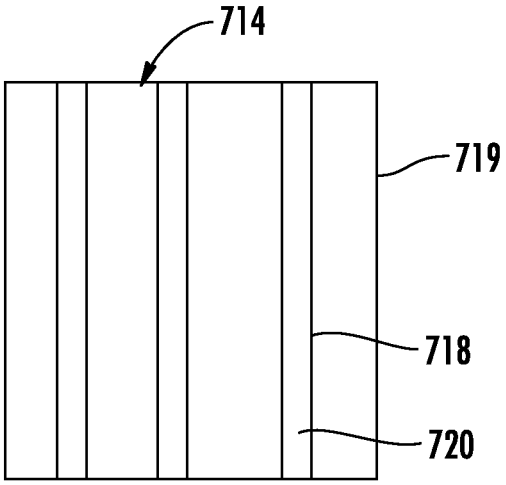
FIG. 15 is a fragmentary view of a bottom more inner portion of another example textile outer layer of the tennis ball of FIG. 12.

FIG. 15 illustrates an underside of an alternative example textile outer layer 714. Layer 714 similar to layer 614 except that in lieu of layer 619 forming pillars 618, layer 714 comprises layer 719 having grooves 718 that have interiors forming voids 720 that face the core, such as core 612. In one implementation, grooves 718 are uniformly spread out and distributed across the inner side of layer 714. In other implementations, grooves 718 may have predefined patterns or arrangements along layer 714. In one implementation, grooves 718 have rectangular cross-sections. In other implementations, grooves 718 may have other geometries. For example, grooves 718 may alternatively comprise grooves having semi oval, semi spherical or triangular shaped cross-sections. Although grooves 718 are illustrated as having a uniform width and depth, in other implementations, grooves 718 may have varying widths and depths amongst the different dimples. The spacing, size, height and surface coverage of grooves 718 enhances the reduction of drag while the same time reducing the extent to which the coefficient of restitution and bounce consistency of the tennis ball employing layer 714.

Figure 16:
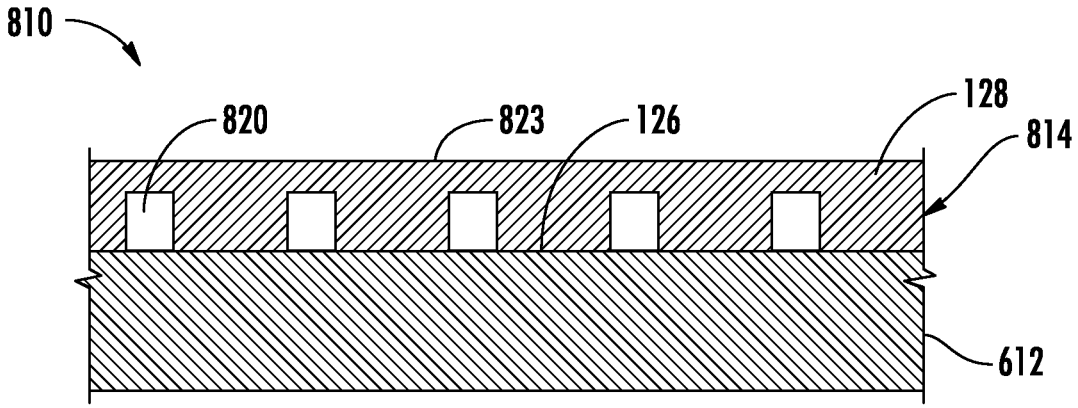
FIG. 16 is a fragmentary sectional view of a portion of another example tennis ball.

FIG. 16 is a sectional illustrating a portion of tennis ball 810, another example implementation of tennis ball 10 as well as tennis ball 610. Tennis ball 810 is similar to a tennis ball 610 except that tennis ball 810 comprises textile outer layer 814 in place of layer 614. Textile outer layer 814 is similar to textile outer layer 114 described above except that layer 814 comprises voids 820 defined between the top or outer surface of scrim layer 126 and the top or outermost surface of layer 128. Voids 820 overlap and/or are aligned with the interstices or spaces within the grid of bars of scrim layer 126. Voids 820 project further operably towards or outermost surface 823 of layer 128. In one implementation, voids 820 are formed by molding such cavities or by removing material of layer 128 prior to the securement of layer 128 to scrim layer 126. In another implementation, voids 820 are formed by removing material of layer 128 through the open spaces in the grid of scrim layer 126 after layer 128 has been secured to scrim layer 126. As with the other balls described herein, voids 820 reduce drag of tennis ball 810 without substantially altering the outer aesthetic appearance of ball 810.

Figure 17:
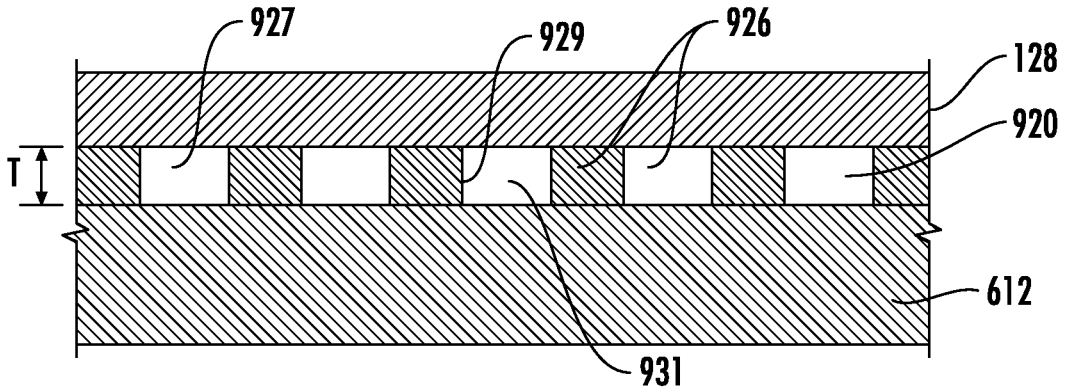
FIG. 17 is a fragmentary sectional view of a portion of another example tennis ball.

FIG. 17 is a sectional view illustrating a portion of tennis ball 910, another example implementation of tennis ball 10 as well as tennis ball 610. Tennis ball 910 is similar to a tennis ball 610 except that tennis ball 910 comprises textile outer layer 914 in place of layer 614. Textile outer layer 914 is similar to textile outer layer 114 described above except that layer 814 comprises scrim layer 926 which forms voids 920 in the interstices or gaps 927 of the grid. As shown by FIG. 17, scrim layer 926 has an inner most surface secured to core 612 and outermost surface secured to layer 128 (by adhesives or needle punching). Unlike scrim layer 126 described above, scrim layer 926 has an enlarged or increased thickness as compared to scrim layers of existing tennis balls. The increased thickness forms voids 927 sufficient volume or size to enhance the reduction of drag.

In one implementation, scrim layer 926 is formed by crisscrossing bars or lines of material that form a grid, wherein the crisscrossing bars or lines 929, 931 having a thickness T within the range of 1 to 4 mm. In one implementation, scrim layer 926 is formed by crisscrossing strands or bars of cotton material. In another implementation, scrim layer 926 is formed by crisscrossing strands or bars of other material, such as a polymer or rubber material. In some implementations, scrim layer 126 of layers 614, 714 or 814 may be replaced with scrim layer 926.

Figure 18:
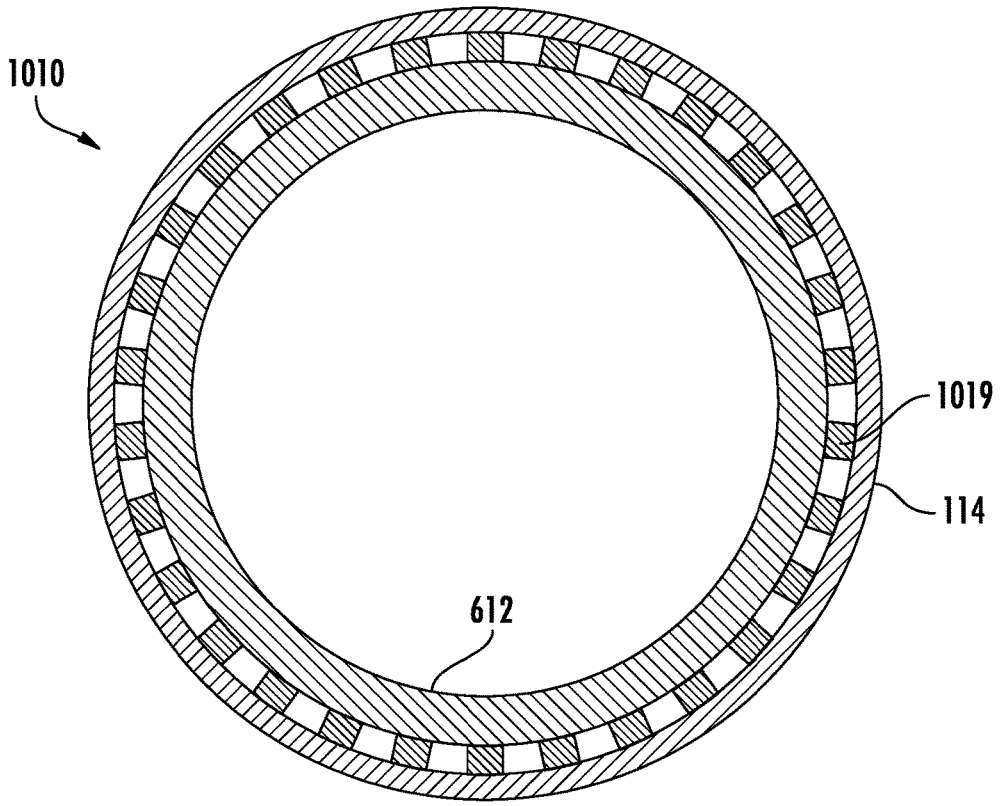
FIG. 18 is a sectional view of another example tennis ball.
Figure 19:
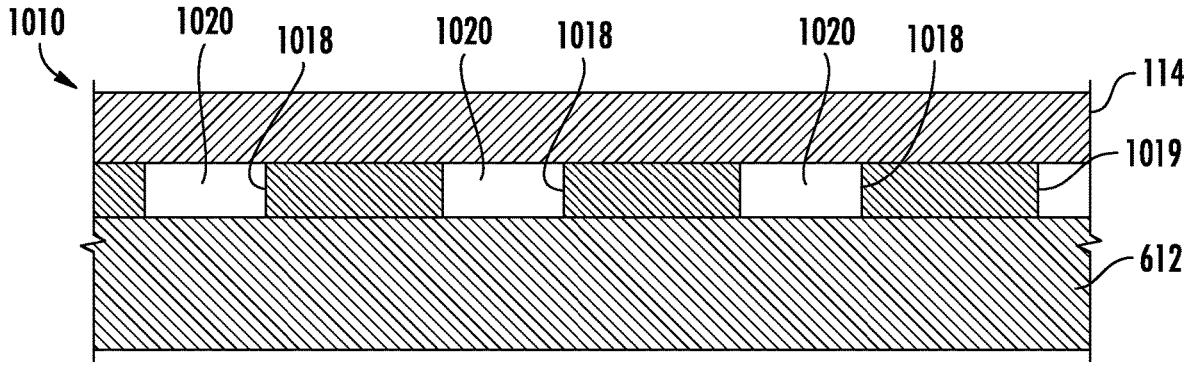
FIG. 19 is a fragmentary sectional view of a portion of the tennis ball of FIG. 18.
Figure 20:
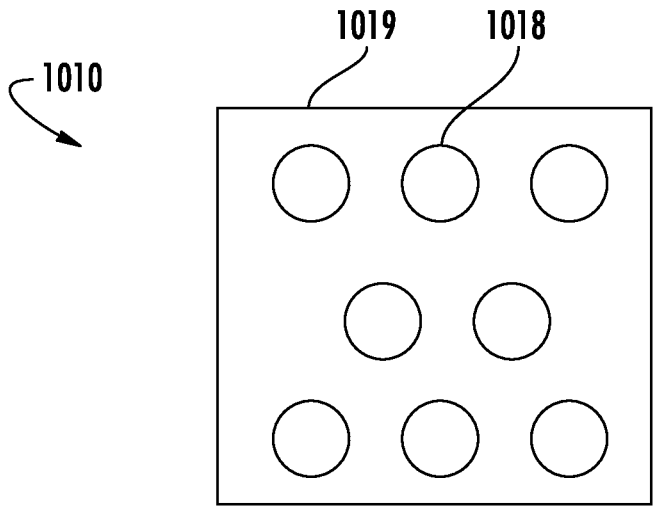
FIG. 20 is a fragmentary view of an intermediate layer of the tennis ball of FIG. 18.

FIGS. 18-20 illustrate tennis ball 1010, another example implementation tennis ball 10. As with the above described tennis balls, tennis ball 1010 has a substantially uniform exterior surface (but for the dog-bone shape seams between panels 122), substantially maintaining the outer aesthetic appearance of the tennis ball 10 while facilitating airflow through a textile layer and across or through the voids 1020, reducing drag and increasing ball speed. The lower drag results in faster ball travel and/or greater travel distance. Such faster ball travel or greater travel distance may prolong the life of the tennis ball 1010. In some circumstances, such faster ball travel/greater travel distance may be preferred by certain tennis players. The lower drag, alone or in combination with other modifications, may further facilitate pressure-less tennis balls.

Tennis ball 1010 provide such voids by using a spacer provided by an additional intermediate layer sandwiched between core 612 and textile outer layer 114, both of which are described above. FIG. 18 is a sectional view of tennis ball 1010 while FIG. 19 is an enlarged sectional of a portion of tennis ball 1010. FIG. 20 is a bottom view of a portion of the intermediate layer 1019.

Intermediate layer 1018 is bonded, needle punched, stitched or otherwise connected to core 612 and textile outer layer 114. In one implementation, intermediate layer 1018 may be provided by two dog-bone shaped panels, having shapes and dimensions similar to panels 122 of layer 114. Intermediate layer 1018 substantially or completely encloses and covers core 612. In one implementation, intermediate layer 1018 comprises layer of a textile material, such as a punched felt or other fabric. In one implementation, layer of fabric or felt may comprise wall or a mixture of wool and nylon. In yet other implementations, intermediate layer 1080 may comprise other materials such as a rubber or polymer.

Layer 1018 comprises through holes 1018, the interiors of which forms voids 1020. As illustrated by FIG. 20, in one implementation, through holes 1018 comprise cylindrical bores having circular cross-sections extending completely through the thickness of intermediate layer 1019. Air passing through textile layer 114 flows in and across voids 1020 to reduce drag of tennis ball 1010. In another implementation, the textile layer 114 follows the contour of the intermediate layer 1019 and extends into the holes 1018.

In one implementation, through holes 1018 are uniformly spread out and distributed across the circumferential surface of core 112. In other implementations, through holes 1018 may have predefined patterns or arrangements along the circumferential surface of core 112. Although through holes 1018 are illustrated as comprising circular cross-sections, in other implementations, through holes 1018 may have other cross-sectional shapes. For example, through holes 1018 may alternatively comprise openings that have oval or polygonal shape cross-sections. Although through holes 1018 are illustrated as having uniform sizes, in other implementations, through holes 1018 may have varying shapes and/or sizes amongst the different dimples. The spacing, size, depth and surface coverage of through holes 1018 enhances the reduction of drag while the same time reducing the extent to which the coefficient of restitution and bounce consistency of ball 1010 is altered.

Figure 21:
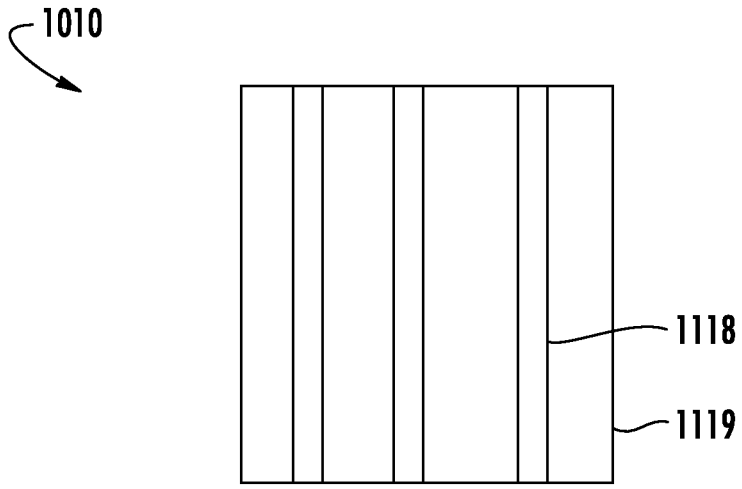
FIG. 21 is a fragmentary view of another example intermediate layer of the tennis ball of FIG. 18.

FIG. 21 is a bottom view of intermediate layer 1119 which may be used in place of intermediate layer 1019 in tennis ball and 1110. Intermediate layer 1119 is similar to layer 1019 except intermediate layer 1119 comprises grooves or channels 1118 which extend completely through layer 1119. In one sense, layer 1119 comprises series of spaced strips secured to core 612 between core 612 and textile outer layer 114.

In one implementation, grooves 1118 are uniformly spread out and distributed across the circumferential surface of core 612. In other implementations, grooves 1118 may have predefined patterns or arrangements along the circumferential surface of core 612. Although grooves 1118 are illustrated as being linear, in other implementations, grooves 1118 may have other geometries. For example, grooves 318 may alternatively comprise grooves curved or tapering opposing sidewalls. Although grooves 1118 are illustrated as being linear, in other implementations, grooves 318 may be zigzagged or curvy in the circumferential plane (in contrast to a plane passing through the center of the tennis ball). The spacing, size, height and surface coverage of grooves 1118 enhances the reduction of drag while the same time reducing the extent to which the coefficient of restitution and bounce consistency of the tennis ball employing core 612.

Figure 22:
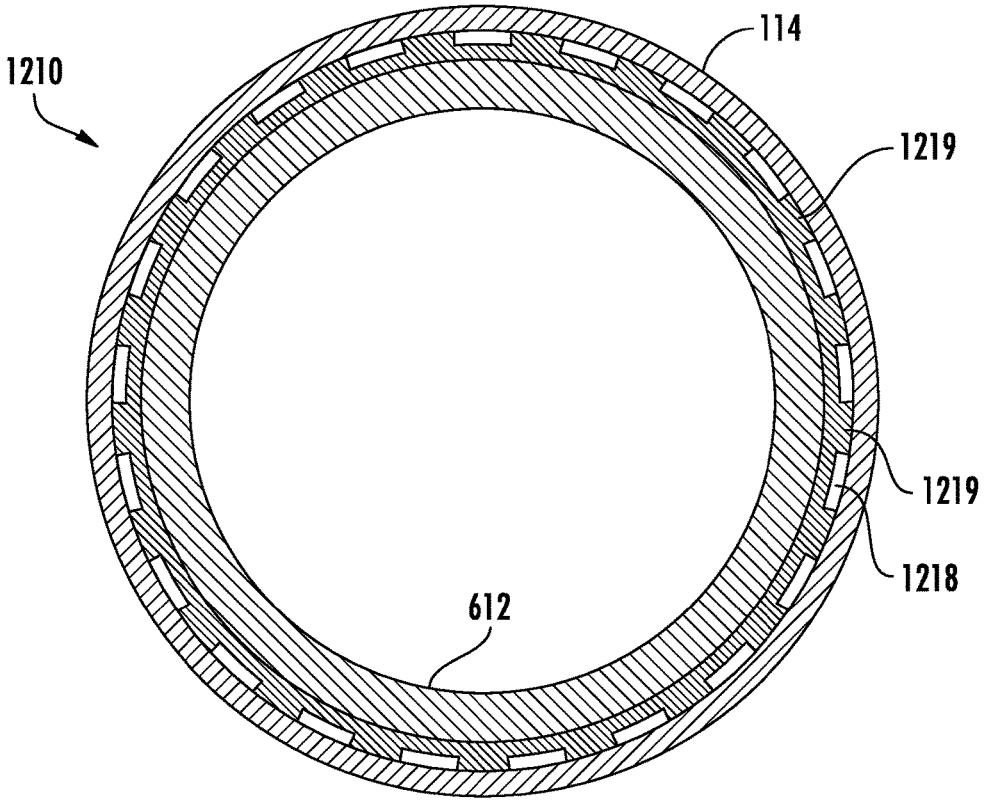
FIG. 22 is a sectional view of another example tennis ball.
Figure 23:
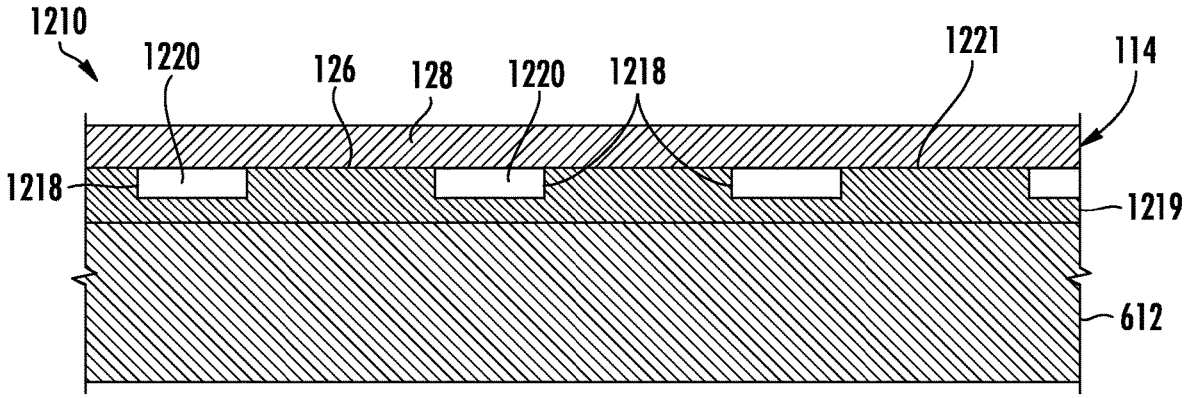
FIG. 23 is a fragmentary sectional view of a portion of the tennis ball of FIG. 22.
Figure 24:
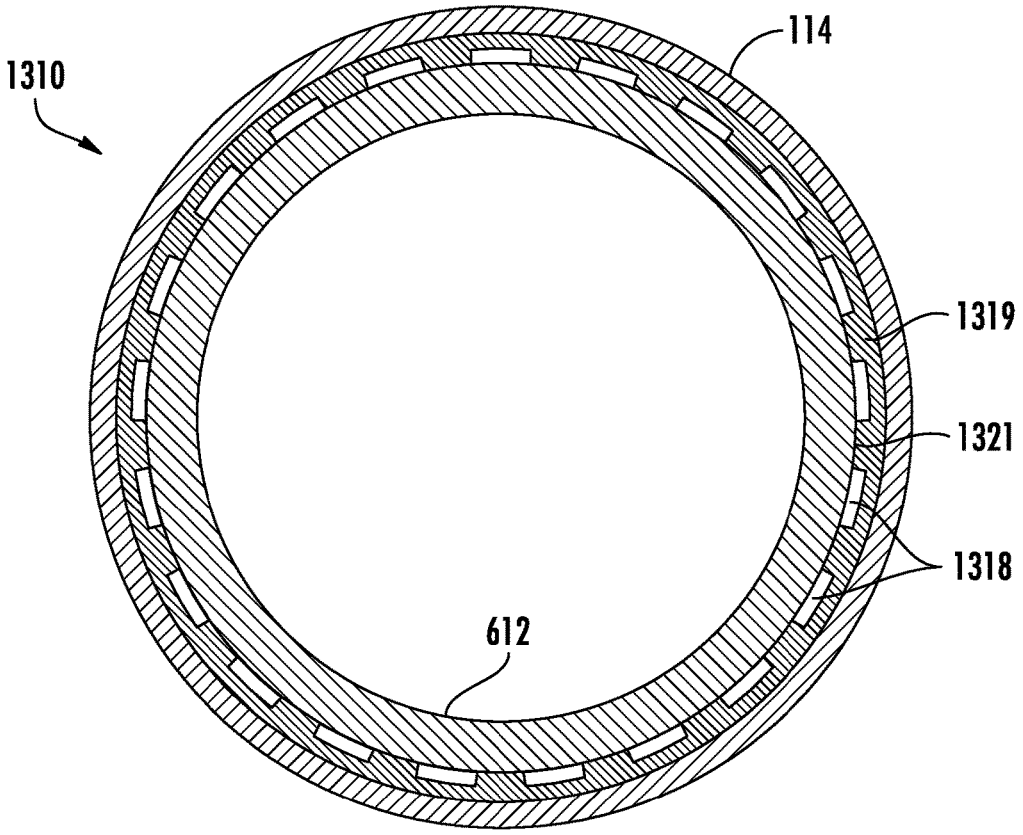
FIG. 24 is a sectional view of another example tennis ball.
Figure 25:
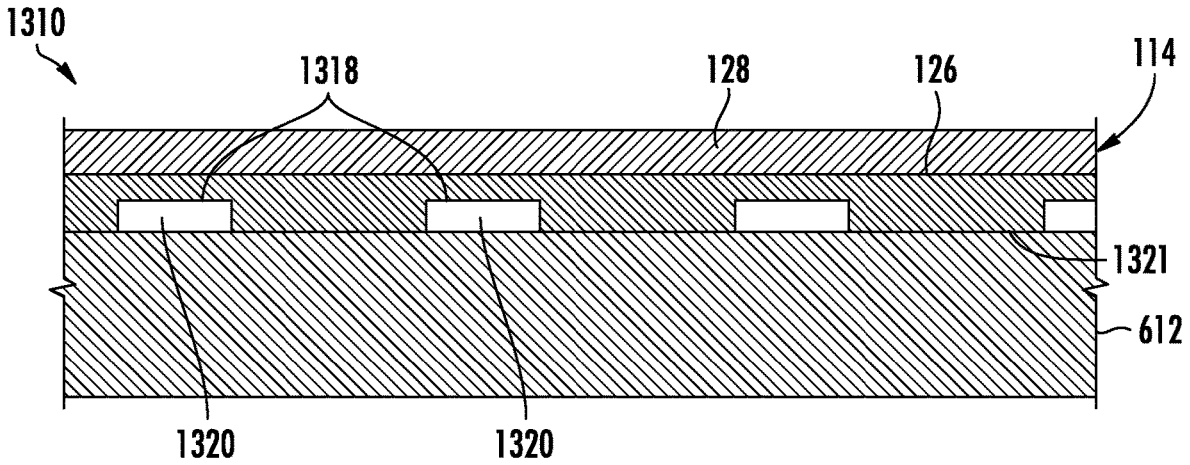
FIG. 25 is a fragmentary sectional view of a portion of the tennis ball of FIG. 24.

FIGS. 22 and 23 illustrate an example tennis ball 1210. FIGS. 24 and 25 illustrate an example tennis ball 1310. Tennis balls 1210 and 1310 are each similar to tennis ball 1010 described above except that tennis balls 1210 and 1310 provide voids provided by cavities that only partially extend into the thickness of an intermediate layer sandwiched between core 612 and textile outer layer 114. As shown by FIGS. 22 and 23, tennis ball 1210 comprises an intermediate layer 1219 which is similar to intermediate layer 1019 except that intermediate layer 1219 comprises cavities 1218 formed along the upper or radially outer most surface 1221 of layer 1219. In one implementation, cavities 1218 comprise dimples partially extending into surface 1221. For example, such cavities 1218 may have a pattern similar to through holes 1018 in FIG. 20. In another implementation, cavities 1218 may comprise channels or grooves partially extending into surface 1221. For example, such cavities 1218 may have a pattern similar to grooves 1118 shown in FIG. 21. In another implementation, the textile layer 114 follows the contour of the intermediate layer 1219 and extends into the cavities 1218.

As shown by FIGS. 24 and 25, tennis ball 1310 comprises an intermediate layer 1319 which is similar to intermediate layer 1019 except that intermediate layer 1319 comprises cavities 1318 formed along the lower or radially inner most surface 1321 of layer 1319. In one implementation, cavities 1318 comprise dimples partially extending into surface 1321. For example, such cavities 1318 may have a pattern similar to through dimples 118 in FIG. 2. In another implementation, cavities 1318 may comprise channels or grooves partially extending into surface 1321. For example, such cavities 1318 may have a pattern similar to grooves 1118 shown in FIG. 21.

Figure 26:
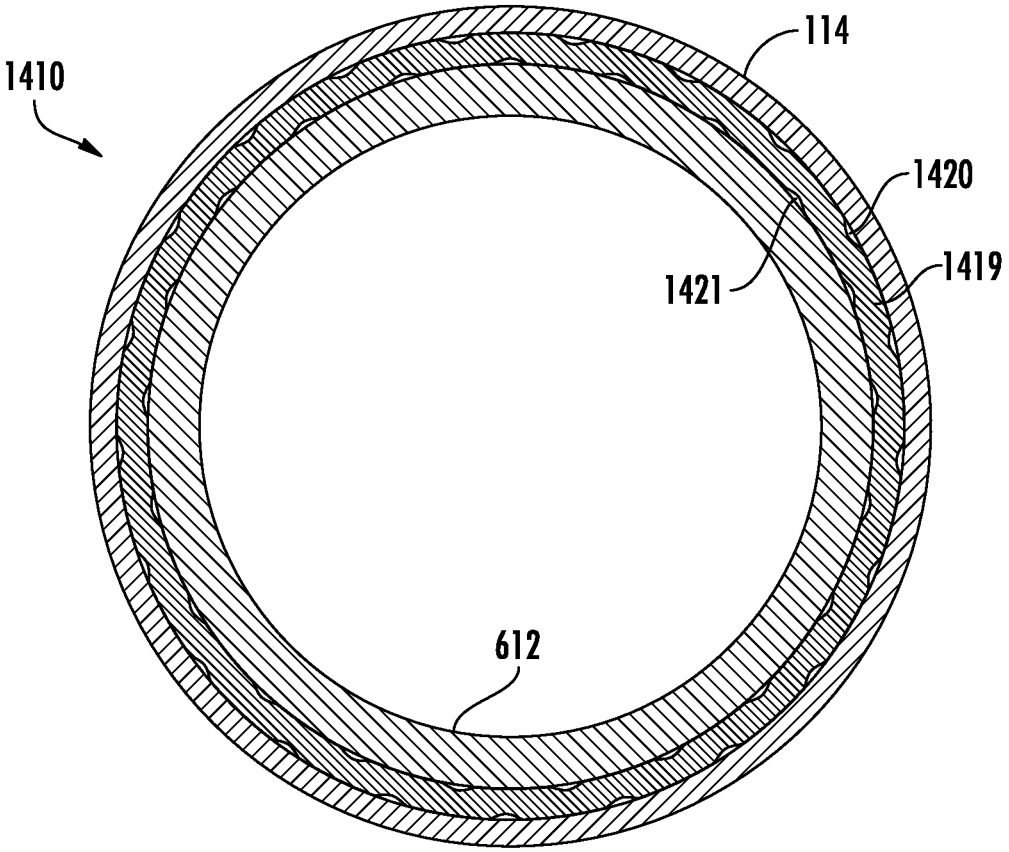
FIG. 26 is a sectional view of another example tennis ball.
Figure 27:
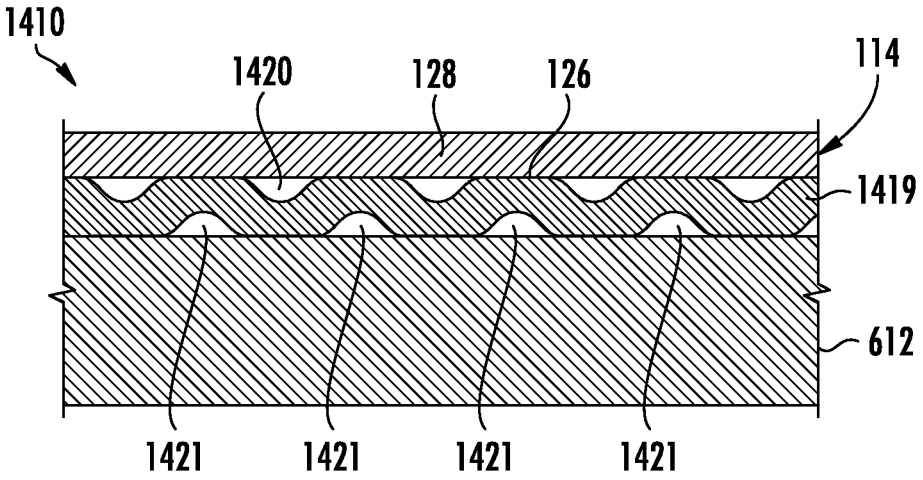
FIG. 27 is a fragmentary sectional view of a portion of the tennis ball of FIG. 26.

FIGS. 26 and 27 illustrate tennis ball 1410 Tennis ball 1310 is similar to tennis balls 1210 and 1310 described above except that tennis ball 1410 provides voids 1420, 1421 provided by cavities resulting from the undulation (waviness) of intermediate layer 1419 sandwiched between core 612 and outer textile layer 114. Although the example illustrates layer 1419 as having a generally smooth undulation or sinusoidal frequency), in other implementations, layer 1419 may undulate in other manners. For example, in other implementations, layer 1419 may undulate in an accordion like or zig-zag manner between core 612 and layer 114. In other implementations, layer 1419 may undulate in a square-wave fashion.

Voids 1420 extend between layer 1419 and layer 114. Voids 1421 extend between layer 1419 and core 612. In the example illustrated, each of voids 1420, 1421 is empty, filled with air. Air flows through and across layer 114 into and across voids 1420 to reduce drag during the travel of ball 1410. In another implementation, textile layer 114 can follow the contour of the intermediate layer 1419 and extend into the voids 1420.

In some implementations, the undulating intermediate layer 1419 may be perforate or may be formed from a textile that facilitate airflow through the intermediate layer and through the inwardly facing valleys or depressions of the undulating intermediate layer forming voids 1421 to provide enhanced drag reduction. In some implementations, the undulating intermediate layer 1419 may be formed from an elastomeric material, enhancing bounce performance. In some implementations, the inwardly facing valleys or depressions forming voids 1421 of the undulating intermediate layer 1419 may be sealed against the circumferential core 612 and may define pressurized volumes between intermediate layer 1419 and the circumferential core 612.

Each of the above described example tennis balls may have implementations that conform to the United States Tennis Association (USTA) and/or International Tennis Federation (ITF) specifications and regulations. For example, in one implementation, each tennis ball may have a substantially smooth outer surface and have a diameter of 6.54-6.86 cm (2.57-2.70 inches) and a mass in the range 56.0-59.4 g (1.98-2.10 ounces). Each of the above described example tennis balls may alternatively be configured for youth tennis, wherein such tennis balls conform to the specifications and regulations of the United States Tennis Association (USTA) and/or International Tennis Federation (ITF) pertaining to such youth programs. Each of such tennis balls have implementations where the tennis balls conform to certain criteria for size, weight, deformation, and bounce criteria to be approved for regulation play. In one implementation, the textile layer may comprise a wool or a wool/nylon mixture. In one implementation, textile layer 14, 114 is formed by woven fibers. In another implementation, textile layer 14, 114 is formed by needle punched fibers.

In one implementation, outer textile layer 14, 114 has a thickness of between 2 and 4 mm, and nominally 3 mm. In one implementation, outer textile layer 14, 114 has a thickness of approximately 3 mm and comprises a mixture of 80% wool and 20% nylon felt. In one implementation, the felt has a cotton scrim layer.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A tennis ball comprising:

a hollow elastic circumferential core; and a textile outer layer extending over and about the core; and a plurality of recesses, wherein each of the plurality of recesses directly underlies and is covered by the textile outer layer so as to be sandwiched between the hollow elastic circumferential core and the textile outer layer, wherein the recesses permit airflow within and through each individual recess of the recesses to reduce drag of the tennis ball.

2. The tennis ball of claim 1, wherein the plurality of recesses are a plurality of circular dimples.

3. The tennis ball of claim 2, wherein the plurality of dimples are arranged in a symmetrical pattern about the core.

4. The tennis ball of claim 1, wherein the plurality of recesses are a plurality of channels.

5. The tennis ball of claim 4, wherein the plurality of channels are spaced apart from each other.

6. The tennis ball of claim 1, wherein the plurality of recesses are selected from the group consisting of: hemispherically shaped dimples, semi-oval shaped recesses, cuboid shaped recesses, pyramid shaped recesses, channels having a U-shaped cross-sectional shape, channels having a V-shaped cross-sectional shape, channels having a rectangular cross-sectional shape and combinations thereof.

7. The tennis ball of claim 1, wherein an outer surface of the outer layer includes a primary outer surface pattern including the recesses and a secondary outer surface pattern that corresponds to the primary outer surface pattern of the core.

8. The tennis ball of claim 1, wherein the core has a spherical outer surface defining the primary outer surface pattern, the outer surface having raised portions and depressed portions amongst the raised portions, the textile layer extending over the depressed portions of the outer surface.

9. The tennis ball of claim 8, wherein the raised portions comprise individual protuberances rising above the depressed portions.

10. The tennis ball of claim 8, wherein the depressed portions comprise dimples, and wherein the raised portions comprise those regions of the outer surface between the dimples.

11. The tennis ball of claim 8, when the depressed portions comprise grooves, and wherein the raised portions comprise those regions of the outer surface between the grooves.

12. The tennis ball of claim 8, wherein the hollow elastic core comprises two joined semi spherical halves.

13. The tennis ball of claim 1, wherein the textile outer layer is a woven felt.

14. The tennis ball of claim 13, wherein when tested with a test setup including a ball velocity of 75 mph, a 5.5 degree launch angle and a spin rate of 1800 rpm, the tennis ball exhibits a coefficient of drag less than 0.6.

15. The tennis ball of claim 1, wherein the textile outer layer is a needle-punch felt.

16. The tennis ball of claim 15, wherein when tested with a test setup including a ball velocity of 75 mph, a 5.5 degree launch angle and a spin rate of 1800 rpm, the tennis ball exhibits a coefficient of drag less than 0.55.

17. The tennis ball of claim 1, wherein the core has a wall thickness within the range of 3.0 to 5.2 mm.

18. A tennis ball comprising:

a hollow elastic circumferential core defining a primary outer surface pattern; and a textile outer layer extending over and about the core, wherein the surface pattern includes a plurality of recesses and wherein the plurality of recesses are a plurality of dimples, wherein each of the plurality of dimples is covered by the textile outer layer so as to form an empty void within each of the dimples and sandwiched between the core and an inner radial surface of the textile outer layer.

19. The tennis ball of claim 1, wherein the textile outer layer at least partially fills the recesses, the textile outer layer facilitating airflow therethrough, through and across each individual recess.

20. The tennis ball of claim 1, wherein the recesses are unfilled and empty, forming empty voids across and through which air may flow to reduce drag of the tennis ball.

21. A tennis ball comprising:

a hollow elastic circumferential core defining a primary outer surface pattern; and a textile outer layer extending over and about the core, wherein the surface pattern includes a plurality of recesses, wherein each of the plurality of recesses directly underlies and is covered by the textile outer layer so as to be sandwiched between the hollow elastic circumferential core and the textile outer layer and wherein the plurality of recesses define a plurality of voids formed between the outer layer and the core.

* * * * *